US008893356B2

(12) United States Patent
Ozaki et al.

(10) Patent No.: US 8,893,356 B2
(45) Date of Patent: Nov. 25, 2014

(54) SLIDER FOR FASTENER

(75) Inventors: Ikuko Ozaki, Osaka-fu (JP); Takeo Takashiro, Osaka-fu (JP)

(73) Assignee: Mupack Ozaki Corporation, Osaka-Fu (JP)

( * ) Notice: Subject to any disclaimer, the term of this patent is extended or adjusted under 35 U.S.C. 154(b) by 321 days.

(21) Appl. No.: 13/055,254

(22) PCT Filed: Oct. 28, 2009

(86) PCT No.: PCT/JP2009/068501

§ 371 (c)(1),
(2), (4) Date: Jan. 21, 2011

(87) PCT Pub. No.: WO2010/134222

PCT Pub. Date: Nov. 25, 2010

(65) Prior Publication Data

US 2011/0126384 A1 Jun. 2, 2011

(30) Foreign Application Priority Data

May 21, 2009 (JP) ..... 2009-122702

(51) Int. Cl.
*A44B 19/26* (2006.01)
*A44B 19/28* (2006.01)
*B65D 33/25* (2006.01)

(52) U.S. Cl.
CPC ..... *B65D 33/2591* (2013.01); *A44B 19/28* (2013.01); *A44B 19/267* (2013.01)
USPC ..... 24/430; 24/415

(58) Field of Classification Search
CPC ..... B65D 33/2591
USPC ..... 383/61.1, 61.2, 62, 64; 24/386, 415, 24/419, 430, 433, 436
See application file for complete search history.

(56) References Cited

U.S. PATENT DOCUMENTS 2,621,387 A * 12/1952 Williams ..... 24/386
6,385,818 B1 * 5/2002 Savicki, Sr. ..... 24/30.5 R (Continued)

FOREIGN PATENT DOCUMENTS

JP 5-91907 A 4/1993
JP 7-284405 A 10/1995

(Continued)

OTHER PUBLICATIONS

International Search Report for the Application No. PCT/JP2009/068501 mailed Feb. 2, 2010.

*Primary Examiner* — Robert J Sandy
*Assistant Examiner* — Louis Mercado
(74) *Attorney, Agent, or Firm* — Cheng Law Group, PLLC

(57) ABSTRACT

The object is to provide a slider for fastener fittable to a fastener included in a sealed reclosable bag after the bag is broken and opened, and also easy to fit to as well as remove from a fastener of another bag. The slider includes to first slider member (2) provided with a projection (2A) for disengaging a male engageable member from a female engageable member both included in a fastener (F) and a second slider member (3) provided with a narrowed portion (3C) for fitting the male and female engageable members to each other. The projection (2A) of the first slider member (2) is adapted to be inserted forcibly from outside between the male and female engageable members in an engaged state, and the narrowed portion (3C) in the second slider member (3) is adapted to engage the male and female engageable members with each other. Two protrusions (2E) each provided with a boss (2I) are provided on the first slider member (2) in a manner extending toward the second slider member (3). A hole (3F) is provided in the second slider member (3), into which the protrusions (2E) are fitted in a manner extending out of the hole (3F). Bosses (3L) are provided in the hole (3F), by which the bosses (2I) on the protrusions (2E) are caught.

7 Claims, 27 Drawing Sheets

(56) References Cited

U.S. PATENT DOCUMENTS

| | | | | |
|---|---|---|---|---|
| 6,431,754 | B1 * | 8/2002 | Savicki, Sr. | 383/64 |
| 7,073,233 | B2 * | 7/2006 | Leva et al. | 24/386 |
| 7,506,417 | B2 * | 3/2009 | Yoneoka | 24/430 |

FOREIGN PATENT DOCUMENTS

| | | | |
|---|---|---|---|
| JP | 2001-130594 | A | 5/2001 |
| JP | 2002-501461 | A | 1/2002 |
| JP | 2002-58509 | A | 2/2002 |
| JP | 2007-529365 | A | 10/2007 |
| JP | 2009-291429 | A | 12/2009 |
| WO | WO-98/21993 | A1 | 5/1998 |
| WO | WO-2005/090179 | A1 | 9/2005 |

* cited by examiner

SLIDER FOR FASTENER

TECHNICAL FIELD

The present invention relates to a slider for fastener applicable to existing reclosable bags with a fastener and even, in particular, to reclosable bags with a fastener in which the upper end portion on the outer side of the fastener is sealed. Such a slider may be fitted to the fastener after the vicinity of the fastener is broken. Such a slider may also be a separable assembly of fittable components to open and close the fastener.

BACKGROUND ART

Many conventional reclosable bags made of synthetic resin film include a fastener (referred to also as zipper). Such a fastener is provided in reclosable bags to prevent the ingress of dust and/or water as well as to prevent articles placed in a reclosable bag from being lost. Most conventional reclosable bags with a fastener are arranged to be unfastened and fastened by opening and closing the fastener by hand or provided with a slider for opening and closing the fastener. That is, in the case of using a slider, a fastener F is provided at a mouth E of a reclosable bag W and an opening/closing slider 10 is fitted to the fastener F, as shown in FIG. 30. Sliding the slider 10 fitted to the fastener F in the direction indicated by the arrow R causes the fastener F to be opened, while sliding in the direction indicated by the arrow S causes the fastener F to be closed.

As shown in FIG. 28(A), such a fastener F typically includes a male engageable member F1 having a projected streak portion F3 and a female engageable member F2 having a recessed engagement groove F4 into which the projected streak portion F3 is fitted engageably and disengageably, the members being provided in an adhesive manner, respectively, on one inner surface W1 and the other inner surface W2 at a mouth E of a bag. When the fastener F of the reclosable bag W is initially closed, the projected streak portion F3 of the male engageable member F1 is fitted in the engagement groove F4 of the female engageable member F2. The mouth E of the reclosable bag W can be opened by inserting the projection 10A of the slider 10 forcibly between the projected streak portion F3 and the engagement groove F4 of the fastener F, as shown in FIG. 28(B), and sliding (moving) the slider 10. The mouth E of the reclosable bag W can be closed by sliding (moving) the slider 10 with the narrowed portion 10C of the slider 10 being placed around the male engageable member F1 and the female engageable member F2, as shown in FIG. 28(C), so that the narrowed portion 10C presses the mouth E of the reclosable bag W on either side thereof.

FIGS. 29(A) and 29(B) are perspective views of the conventional slider 10, respectively, an overall view and view of the slider cut from center. In these figures, for descriptive convenience, the slider is turned upside down (the projection 10A and the narrowed portion 10C are directed upward) contrary to its normal use. As shown in these figures, the conventional slider 10 includes the projection 10A provided in a standing manner within an inner space 10E having a wide central portion nearer one side along its centerline, sidewalls 10D, 10D provided in a standing manner on lateral ends of a bottom portion 10B, and wall portions 10F, 10F constituting the narrowed portion 10C nearer the other side. The slider 10 may be fitted later to the fastener F provided at the mouth E of the reclosable bag W. This arrangement allows the slider 10 to be fitted, as described above, by forcing the projection 10A of the slider 10 downward and placing the narrowed portion 10C around the mouth E of the reclosable bag W. In this state, sliding the slider 10 in the direction indicated by the arrow R (see FIG. 30) allows the fastener F at the mouth E to be opened, while sliding in the direction indicated by the arrow S allows the fastener F at the mouth E to be closed.

Sliders of the type shown in FIG. 30 are most useful, but a little more complex die is necessarily required for manufacturing of such sliders. Hence, the present applicant has proposed such a sectional slider for fastener as shown in FIGS. 26 and 27. That is the slider 31 for fastener includes a slider member 32 formed with a projection 32A for disengaging a male engageable member F1 from a female engageable member F2 both included in a fastener F, the male engageable member F1 having a projected streak portion F3 and the female engageable member F2 having an engagement groove into which the projected streak portion F3 is fitted engageably and disengageably, the members being provided, respectively, on one inner surface and the other inner surface at a mouth of a bag, and another slider member 33 formed with a narrowed portion 33C for fitting the male engageable member F1 into the female engageable member F2. The slider 31 for fastener also has a structure in which the separately-formed slider members 32 and 33 are fitted to each other (refer to Patent Literature 1).

In addition, sidewalls 32C are formed on lateral ends of the slider member 32 having the projection 82A, while columnar portions 33A are formed on either side of the narrowed portion 33C in the slider member 33, and recessed portions 33E are formed on the outer side of the respective columnar portions 33A, whereby the sidewalls 32C can be fitted to the respective recessed portions 33E (refer to Patent Literature 1).

Patent Literature 1: Japanese Patent Application No. 2008-148231

DISCLOSURE OF THE INVENTION

Problems to be Solved by the Invention

The slider 10 shown in FIG. 30 can close the fastener F provided at the mouth of the reclosable bag W. There are, however, reclosable bags, such as shown in FIG. 25, including a fastener F and a sealed end portion on the outer side of the fastener. The fastener F is provided in such reclosable bags W for dosing purpose after opening to prevent the ingress of dust and/or water as well as to prevent articles placed in the reclosable bag W from being spilt. However, such reclosable bags W including a closing fastener cannot employ a slider 10. Once such a bag is opened by, for example, breaking the vicinity of the fastener F by hand or cutting with scissors, the bag can only be reclosed by, for example, pressing the fastener F by hand or reopened by, for example, inserting a hand (finger) through the broken side. In addition, separable sliders 31 of the type shown in FIG. 26 are less easy to disassemble after once assembled and fitted to the fastener F, which makes their removal and reuse cumbersome and complicated. There is another problem in that the slider member 32, when reaching one end of the fastener F of the reclosable bag W, travels accordingly outside the fastener to easily fall off. There is a further problem in that one of the slider members 32 and 33 is easily lost when disassembled because the slider is a separable one.

The present invention has been made to solve the above-described problems, and an object thereof is to provide a slider for fastener fittable to a fastener included in a sealed reclosable bag W after the bag is broken and opened, having a relatively simple structure to be also fittable from one end of the fastener, and easy to remove even after once fitted to the fastener of the bag. It is another object of the present invention to provide a slider for fastener easy to remove from the fastener and to fit to as well as remove from a fastener of another bag, adapted to stop, even when reaching one end of the reclosable bag W, not to be disengaged from the fastener F of the reclosable bag W, and not completely separable, even when the slider members may be separated, so that neither one of the slider members can be lost.

Means for Solving the Problems

In order to achieve the foregoing objects, a first aspect of the present invention is directed to a slider for fastener including: a first slider member (2, 22) formed with a projection (2A, 22A) for disengaging a male engageable member from a female engageable member both included in a fastener (F), the male engageable member having a projected streak portion and the female engageable member having an engagement groove into which the projected streak portion is fitted engageably and disengageably, the male and female engageable members being provided, respectively, on one inner surface and the other inner surface opposed to the one inner surface in an openable end portion of a reclosable bag; and a second slider member (3, 23) formed with a narrowed portion (3C, 23C) for engaging the male and female engageable members with each other, the slider for fastener being formed by fitting the first slider member (2, 22) and the second slider member (3, 23) to each other, in which the first slider member (2, 22) is formed with the projection (2A, 22A), which is adapted to be inserted forcibly between the male and female engageable members included in the fastener (F) of the reclosable bag in an engaged state from outside the fastener (F), and two protrusions (2E, 22E) extending toward the second slider member (3, 23), and in which the second slider member (3, 23) is provided with the narrowed portion (3C, 23C), which is adapted to engage the male and female engageable members with each other, and a hole (3F, 23F) into which the two protrusions (2E, 22E) are fitted, the slider for fastener having a structure in which the two protrusions (2E, 22E) on the first slider member (2, 22) extend out of the hole (3F, 23F) in the second slider member (3, 23) when the first slider member (2, 22) and the second slider member (3, 23) are fitted to each other.

A second aspect of the present invention is directed to a slider for fastener including: a first slider member (2, 22) formed with a projection (2A, 22A) for disengaging a male engageable member from a female engageable member both included in a fastener (F), the male engageable member having a projected streak portion and the female engageable member having an engagement groove into which the projected streak portion is fitted engageably and disengageably, the male and female engageable members being provided, respectively, on one inner surface and the other inner surface opposed to the one inner surface in an openable end portion of a reclosable bag; and a second slider member (3, 23) formed with a narrowed portion (3C, 23C) for engaging the male and female engageable members with each other, the slider for fastener being formed by fitting the first slider member (2, 22) and the second slider member (3, 23) to each other, in which the first slider member (2, 22) is formed with the projection (2A, 22A), which is adapted to be inserted forcibly between the male and female engageable members included in the fastener (F) of the reclosable bag in an engaged state from outside the fastener (F), and two protrusions (2E, 22E) extending toward the second slider member (3, 23) and each having a boss (2I, 22I) at a leading end thereof, and in which the second slider member (3, 23) is provided with the narrowed portion (3C, 23C), which is adapted to engage the male and female engageable members with each other, and a hole (3F, 23F) into which the two protrusions (2E, 22E) are fitted, the hole (3F, 23F) being formed with recessed portions (3H, 23H) at an exit end thereof to which the bosses (2I, 22I) at the leading ends of the two protrusions (2E, 22E) are fitted respectively, the slider for fastener having a structure in which the two protrusions (2E, 22E) on the first slider member (2, 22) extend out of the hole (3F, 23F) in the second slider member (3, 28) when the first slider member (2, 22) and the second slider member (3, 23) are fitted to each other.

A third aspect of the present invention is directed to a slider for fastener including: a first slider member (22) formed with a projection (22A) for disengaging a male engageable member from a female engageable member both included in a fastener (F), the male engageable member having a projected streak portion and the female engageable member having an engagement groove into which the projected streak portion is fitted engageably and disengageably, the male and female engageable members being provided, respectively, on one inner surface and the other inner surface opposed to the one inner surface in an openable end portion of a reclosable bag; and a second slider member (23) formed with a narrowed portion (23C) for engaging the male and female engageable members with each other, the slider for fastener being formed by fitting the first slider member (22) and the second slider member (23) to each other, in which the first slider member (22) is provided with the projection (22A), which is adapted to be inserted forcibly between the male and female engageable members included in the fastener (F) of the reclosable bag in an engaged state from outside the fastener (F), and two protrusions (22E) extending toward the second slider member (23) and each having a boss (22I) at a leading and thereof, and in which the second hider member (23) is provided with the narrowed portion (23C), which is adapted to engage the male and female engageable members with each other, and a hole (23F) into which the two protrusions (22E) are fitted, the hole (23F) being formed with: recessed portions (23H) at an exit end thereof to which the bosses (22I) at the leading ends of the two protrusions (22E) are fitted respectively; and bosses (23L), on the side nearer the first slider member, adapted to be engaged, respectively, with the bosses (22I) at the leading ends of the two protrusions (22E) provided on the first slider member (22).

In a fourth aspect of the present invention, inner walls (3D, 23D) on either side of the narrowed portion (3C, 23C) in the second slider member (3, 23) are each formed with a recessed portion (3E, 23E) to which the bulge of the fastener of the reclosable bag is fitted.

In a fifth aspect of the present invention, the slider for fastener is adapted to be fitted after a sealed end portion on the outer side of the fastener (F) of the reclosable bag is broken.

In a sixth aspect of the present invention, the projection (2A, 22A) is formed with another projection (2J, 22J) extending in the sliding direction with a height smaller than that of the first projection (2A, 22A).

In a seventh aspect of the present invention, a constriction (2Q, 22Q) is provided in the vicinity of the leading end of the projection (2A, 22A) on the first slider member (2, 22).

Advantages

The slider for fastener according to any of the foregoing aspects of the present invention can be fitted to a fastener included in a sealed reclosable bag after the vicinity of the fastener is broken by hand or cut with scissors, for example. In this case, the first slider member with the projection and the second slider member with the narrowed portion may be produced separately and fitted easily to each other to be a slider like typical ones.

This slider can open the fastener in a closed state by easily inserting the first slider member with the projection forcibly between the engageable members of the fastener. Also, the slider for fastener according to the present invention, even if once fitted to the mouth of the reclosable bag to open and close the fastener, can be disassembled and removed into the first and second slider members only by pinching the two protrusions so as to come close to each other.

The slider for fastener according to the present invention can be in a "semi-fitted state" where the first and second slider members are not separated. This reduces the possibility of losing one of the slider members. That is, as shown in FIGS. 1 and 5, this slider serves as a typical one when the first slider member 2 and the second slider member 3 are fitted to each other. However, when the two protrusions 22E are pinched to be pulled off the hole 23F in the second slider member 23, the bosses 22I. 22I on the two protrusions 22E are caught by the respective bosses 23L formed on the inner walls of the bole 23F on the side nearer the first slider member 22 as shown in FIG. 20(B), which causes the slider to be in a "semi-fitted state". The slider members are thus separated while remaining linked to each other and thereby cannot fall off. Also, in this "semi-fitted state", the first slider member 22 can be fitted easily to the fastener F.

The slider for fastener according to any of the foregoing aspects of the present invention can be fitted to a fastener included in a sealed reclosable bag after the vicinity of the fastener is broken by hand or out with scissors, for example. In this case, the first slider member with the projection and the second slider member with the narrowed portion may be produced separately and fitted easily to each other to be a slider like typical ones.

In particular, the slider for fastener according to the present invention can be easily fitted to and removed from a fastener included in a sealed reclosable bag after the vicinity of the fastener is broken by hand or cut with scissors, for example. Therefore, the slider is applicable to most types of sealed reclosable bags with a fastener. Particularly, in accordance with the seventh aspect, the projected streak portion of the fastener can be fitted to the constriction to be stably disengaged from the engagement groove into which the projected streak portion is fitted. Then, in accordance with the fourth aspect, the bulge of the fastener of the reclosable bag can be fitted to the recessed groove in the narrowed portion so that the slider is fitted stably.

Moreover, the slider for fastener according to the present invention, which consists of two separate components to be fitted to each other, can be produced with a simply-structured molding the at low cost. Further, the first slider member may be fitted laterally at one end of the fastener, and the second slider member may separately be fitted from above the fastener such that the narrowed portion is placed around the fastener, and then fitted to the first slider member.

BRIEF DESCRIPTION OF THE DRAWINGS

FIG. 16 shows a slider for fastener according to a second preferred embodiment of the present invention, where

FIG. 17 shows the second preferred embodiment of the present invention, viewed in another direction, where

FIG. 18 shows the slider for fastener according to the second preferred embodiment of the present invention, turned upside down, where

BEST MODE FOR CARRYING OUT THE INVENTION

Preferred embodiments of the present invention will hereinafter be described specifically in detail with reference to the accompanying drawings.

Figure 1:
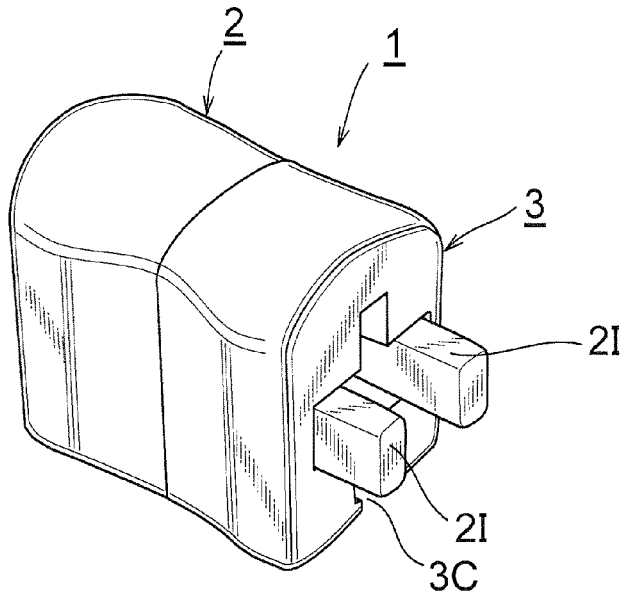
FIG. 1 is an overall perspective view of a slider 1 for fastener according to the present invention in an assembled state.
Figure 2:
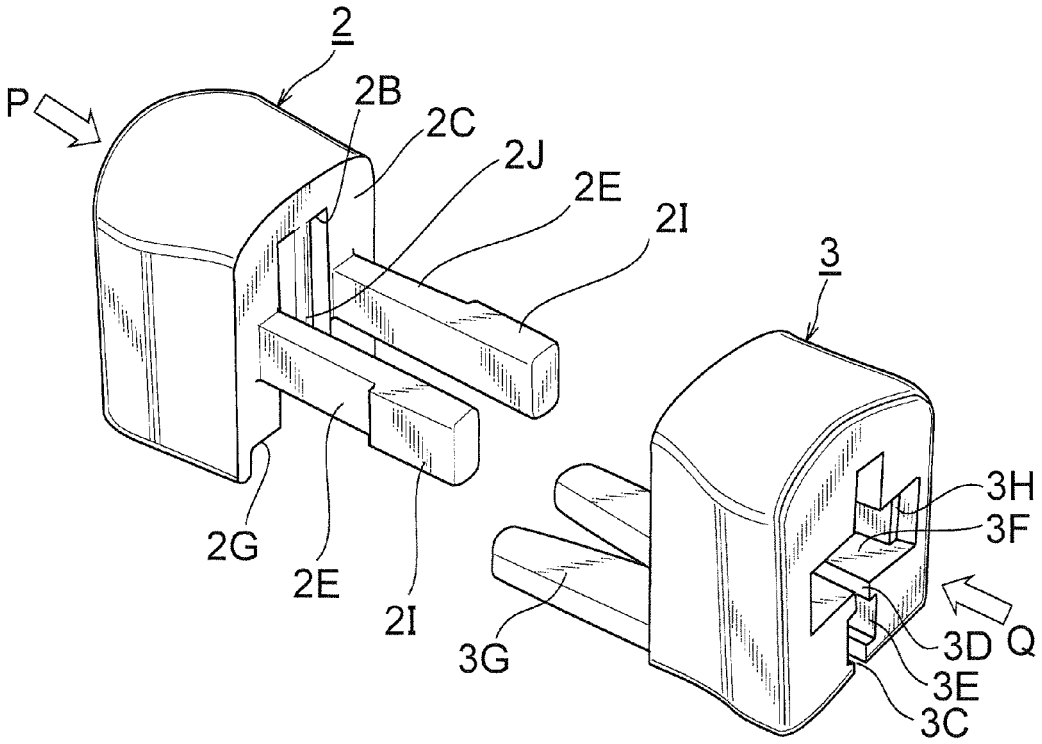
FIG. 2 is an exploded perspective view of a first slider member and a second slider member included in the slider for fastener according to the sent invention in a pre-fitted and -assembled state.
Figure 3:
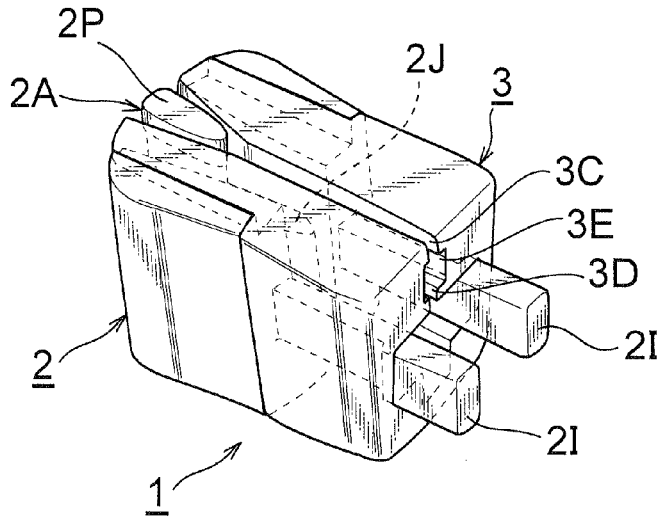
FIG. 3 is an assembled perspective view showing a state where the members are fitted to each other as shown in FIG. 1 and turned upside down.
Figure 4:
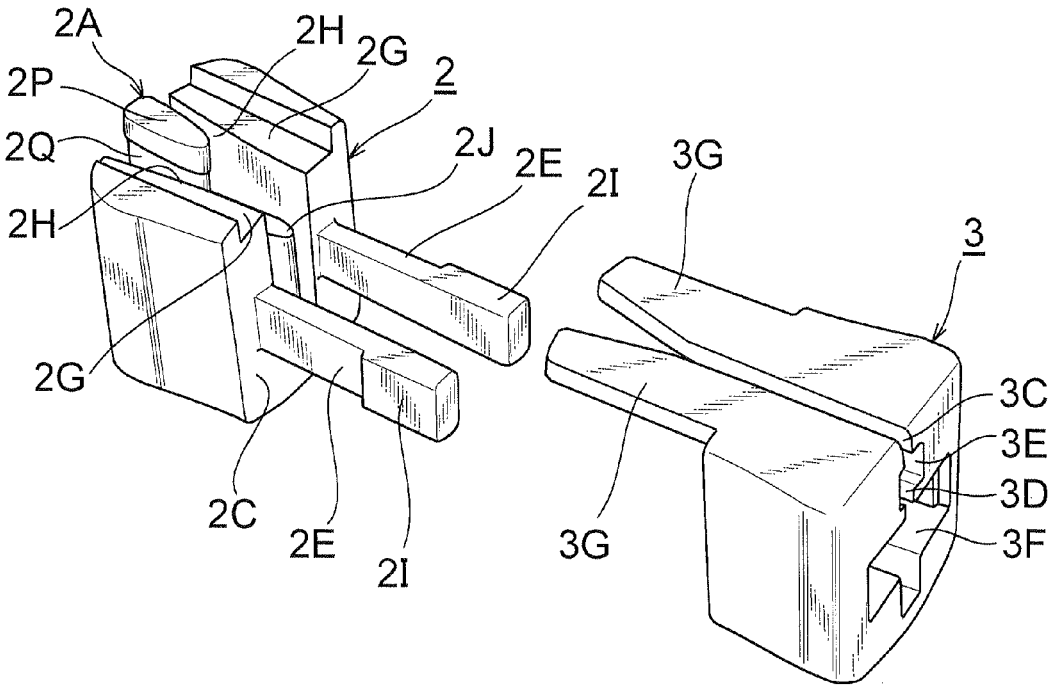
FIG. 4 is an exploded perspective view showing a state where the first and second slider members in a pre-assembled state are turned upside down.
Figure 5A:
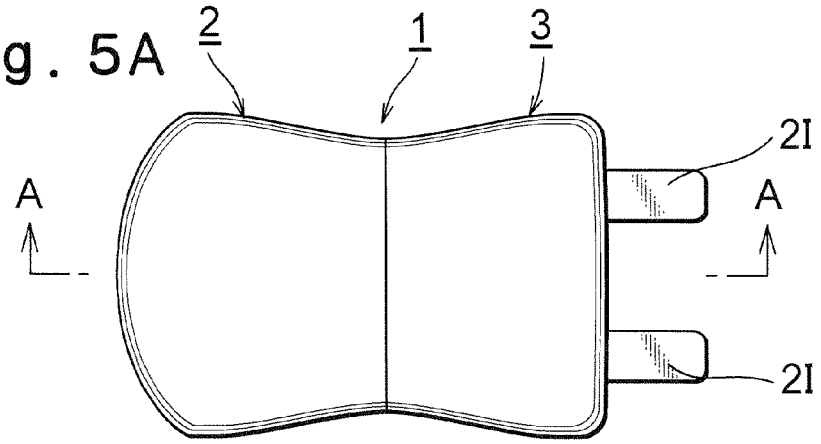
FIGS. 5(A), 5(B), and 5(C) are respectively, plan, front, and bottom views of the slider 1 for fastener according to the present invention in an assembled state.
Figure 5B:
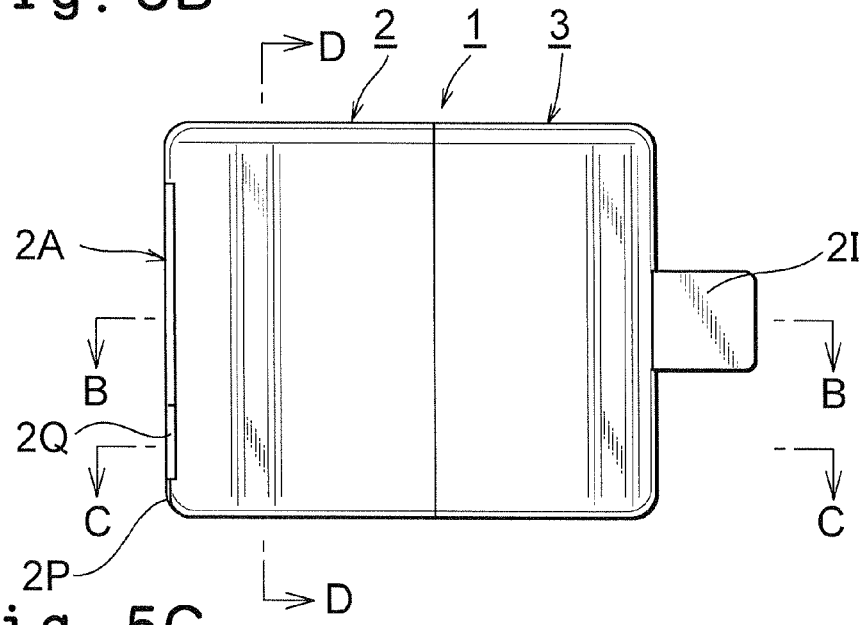
Figure 5C:
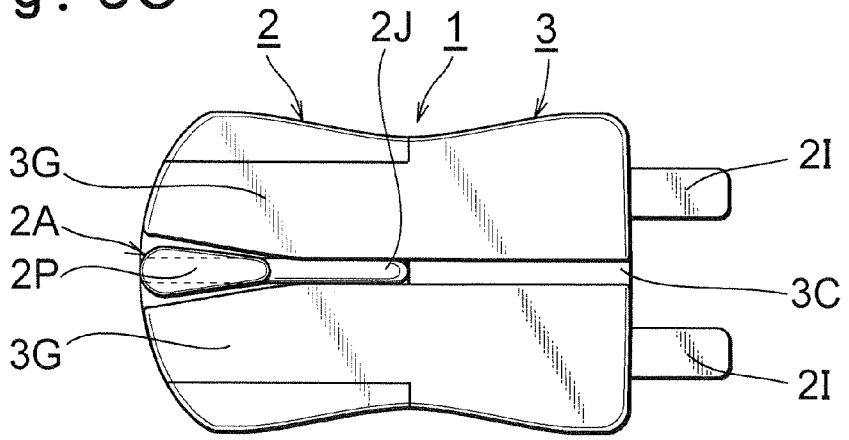
Figure 6A:
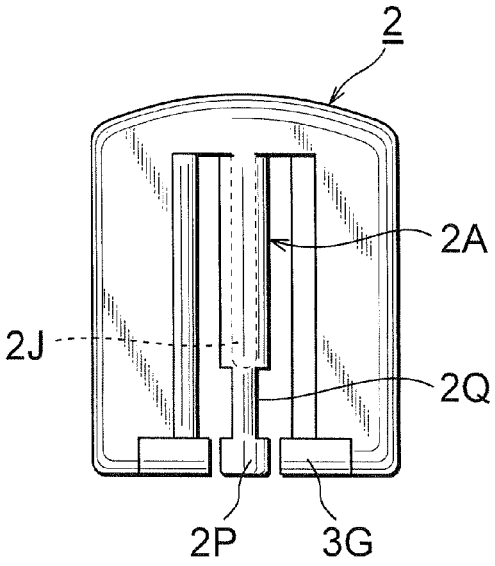
FIG. 6(A) is a side view of the first slider member 2 of the slider 1 for fastener according to the present invention, viewed in the direction indicated by the arrow P.
Figure 6B:
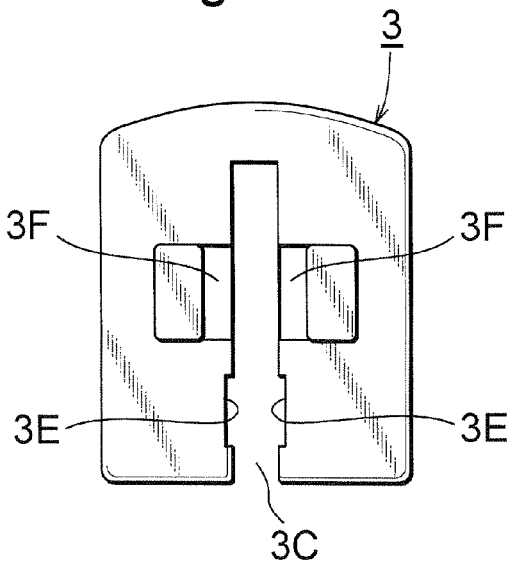
FIG. 6(B) is a side view of the second slider member 3, viewed in the direction indicated by the arrow Q.
Figure 7A:
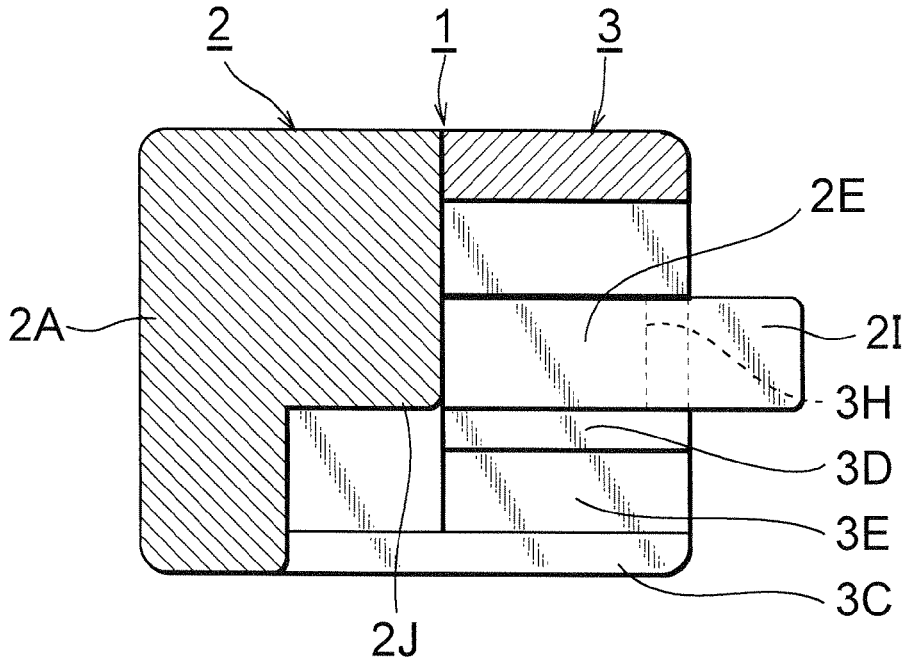
FIG. 7(A) is a cross-sectional view along the arrows A-A in FIG. 5(A)
Figure 7B:
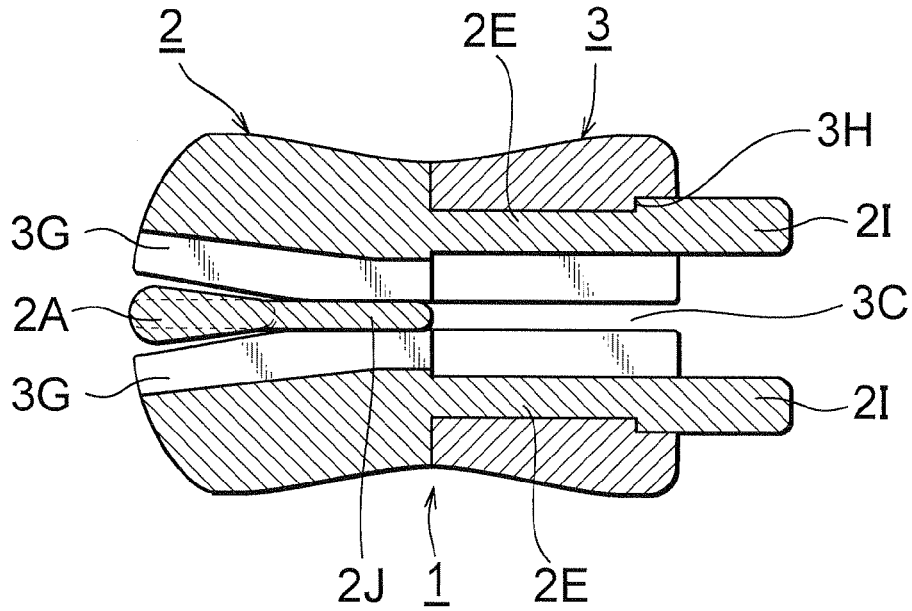
FIG. 7(B) is a cross-sectional view along the arrows B-B in FIG. 5(B).
Figure 8A:
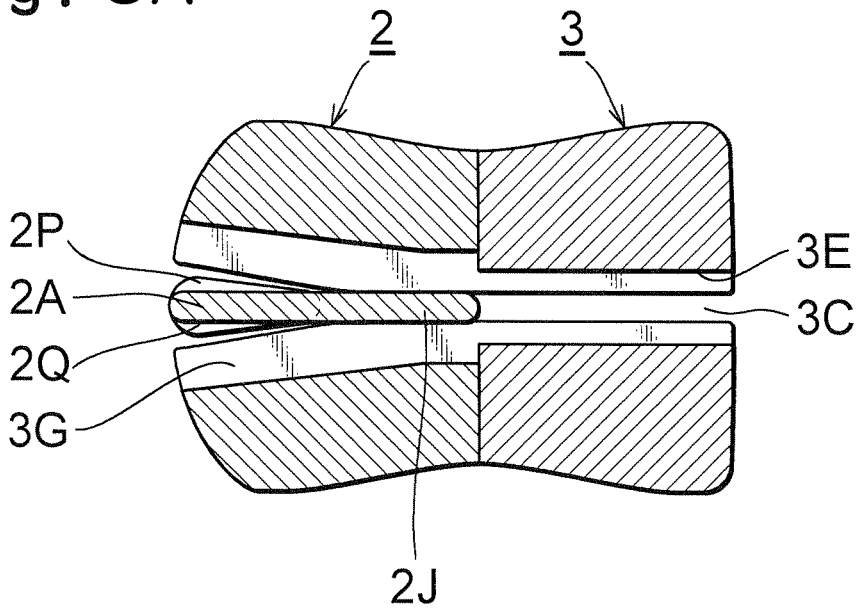
FIG. 8(A) is a cross-sectional view along the arrows C-C in FIG. 5(B)
Figure 8B:
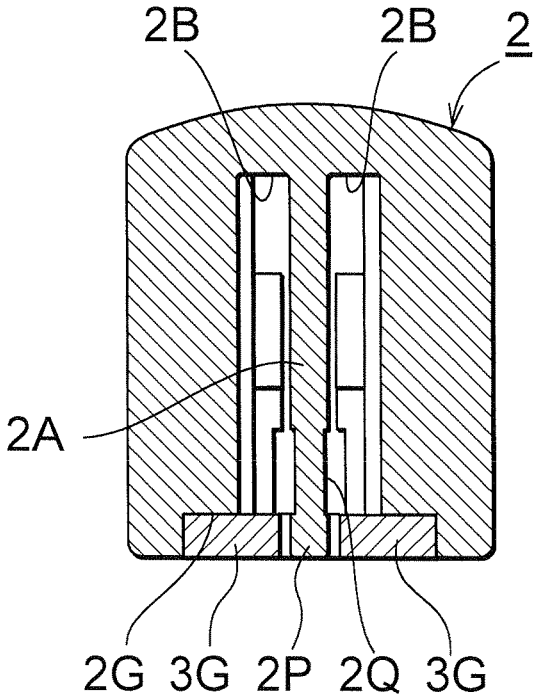
FIG. 8(B) is a cross-sectional view along the arrows D-D in FIG. 5(B).

FIG. 1 is an overall perspective view of a slider 1 for fastener according to the present invention in an assembled state. FIG. 2 is an exploded perspective view of a first slider member 2 and a second slider member 3 included in the slider 1 for fastener according to the present invention in a pre-fitted and -assembled state. FIG. 3 is an assembled perspective view showing a state where the members are fitted to each other as shown in FIG. 1 and turned upside down. FIG. 4 is an exploded perspective view showing a state where the first and second slider members 2 and 3 shown in FIG. 3 in a pre-fitted and -assembled state are turned upside down. FIGS. 5(A), 5(B), and 5(C) are, respectively, plan, front, and bottom views of the slider 1 for fastener according to the present invention in an assembled state. FIG. 6(A) is a side view of the first slider member 2 of the slider 1 for fastener according to the present invention, viewed in the direction indicated by the arrow P in FIG. 2, and FIG. 6(B) is a side view of the second slider member 3, viewed in the direction indicated by the arrow Q in FIG. 2. FIG. 7(A) is a cross-sectional view along the arrows A-A in FIG. 5(A), and FIG. 7(B) is a cross-sectional view along the arrows B-B in FIG. 5(B). FIG. 8(A) is a cross-sectional view along the arrows C-C in FIG. 5(B), and FIG. 8(B) is a cross-sectional view along the arrows D-D in FIG. 5(B).

As shown in FIGS. 1 to 4, the slider 1 for fastener according to the present invention includes a projection 2A adapted to disengage a male engageable member F1 and a female engageable member F2 (F1, F2 not shown) of a fastener (see FIG. 19) and another projection 2J having a height smaller than that of the projection 2A. The slider 1 also includes a first slider member 2 formed with two protrusions 2E, 2E and a second slider member 3 formed with a narrowed portion 3C for engaging the male and female engageable members F1 and F2 with each other. The projection 2A of the first slider member 2 is provided in a standing manner on a bottom portion 2B (see FIGS. 2 and 8(B)), bile the two protrusions 2E, 2E are provided in a manner extending toward the second slider member 3 and also in a standing manner on a fitting surface 2C that faces the second slider member 3. Further, a through hole 3F into which the two protrusions 2E, 2E are fitted is provided in the second slider member 3. The slider 1 has a structure in which the two protrusions 2E, 2E on the first slider member 2 extend a little out of the hole 3F in the second slider member 3 when the first and second slider members 2 and 3 are fitted to each other.

Figure 9:
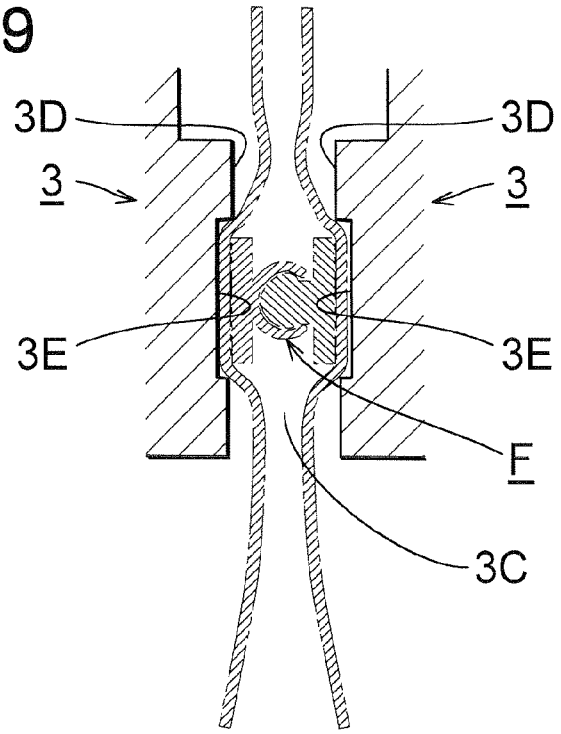
FIG. 9 is a partially enlarged view showing a state where a fastener is placed and closed inside a narrowed portion in the second slider member according to the present invention.

As described above, the second slider member 3 is formed with the narrowed portion 3C to be placed around the fastener F. Then, as shown in FIG. 9, grooves 3E, 3E into which the fastener F is to be fitted naturally are provided in sidewalk 3D, 3D on either side of the narrowed portion 3C. The convex bulge formed by the male and female engageable members F1 and F2 is to be fitted to the grooves 3E, 3E, whereby the slider 1 for fastener can be fitted stably to the fastener F of the reclosable bag W.

Figure 10:
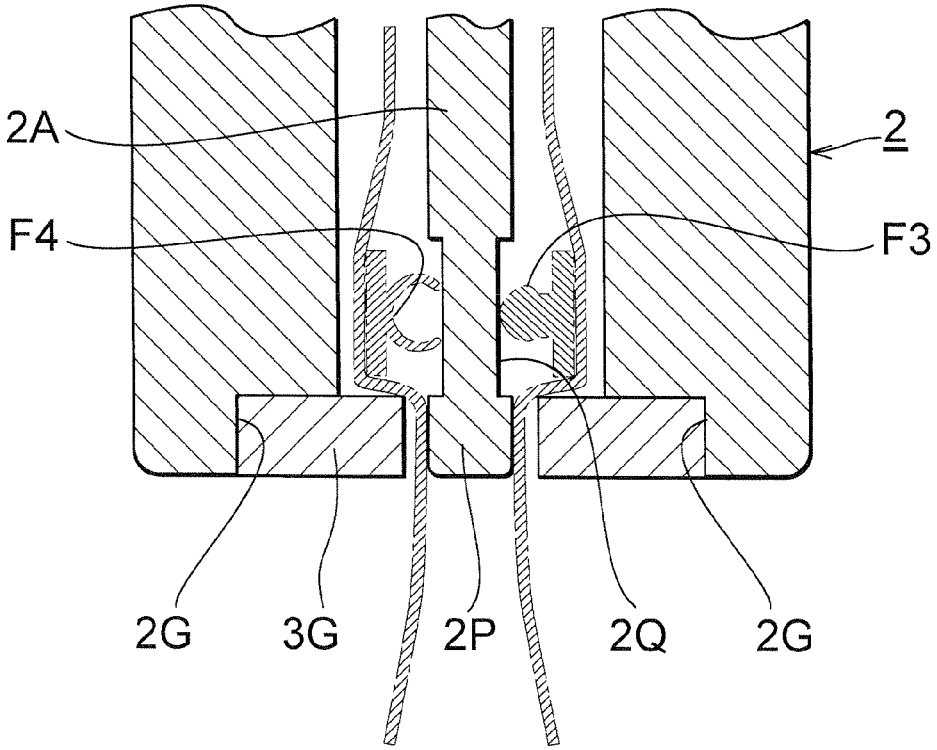
FIG. 10 is a partially enlarged view showing a state where a projection on the first slider member according to the present invention is inserted forcibly into a closed fastener.

The leading end 2P of the projection 2A on the first slider member 2 may be a little rounded to be inserted easily between the engageable members of the fastener F. A constriction 2Q is then provided in the vicinity of the leading end 2P of the projection 2A. As shown in FIG. 10, when the projection 2A is inserted forcibly between the male and female engageable members F1 and F2 of the fastener, the projected streak portion F3 and the engagement groove F4 of the fastener in an disengaged state are fitted to the constriction 2Q in the vicinity of the leading end 2P, so that the projected streak portion F3 can be disengaged stably from the engagement groove F4 into which the projected streak portion F3 is fitted. The projection 2A on the first slider member 2 is formed with the projection 2J, which extends continuously in the sliding direction with a height a little smaller than that of the projection 2A.

The hole 3F in the second slider member 3 is provided in a position where the two protrusions 2E, 2E are just fitted when the first and second slider members 2 and 3 are fitted to each other. In this case, the two protrusions 2E, 2E extend a little out of the hole 3F in the second slider member 3. This is for the reason that the two protrusions 2E, 2E in the state shown in FIG. 1 can be pinched with fingers. Accordingly, the two protrusions 2E, 2E, when pinched with fingers, deforms elastically to come close to each other and thereby to be pulled easily off the hole 3F. When the two protrusions 2E, 2E thus come close to each other to be pulled easily off the hole 3F, the slider 1 can also be removed easily from the fastener F of the reclosable bag W and further, advantageously, be changed easily.

As shown in FIGS. 3 and 4, the slider 1 then has a structure in which stepped portions 2G, 2G are formed in the upper part of inner walls 2H, 2H on the opposite side (base side) of the two protrusions 2E, 2E on the first slider member 2, while protrusions 3G, 3G to be fitted to the stepped portions 2G, 2G are formed on the second slider member 3 that is provided with the hole 3F into which the two protrusions 2E, 2E are fitted. Therefore, the first and second slider members 2 and 3 can be fitted firmly to each other through fitting between the stepped portions 2G and the protrusions 3G.

Alternatively, the slider 1 may have a structure in which protrusions like the protrusions 3G are formed on the first slider member 2 that is provided with the two protrusions 2E, 2E, while stepped portions like the stepped portions 2G are formed on the second slider member 3 that is provided with the hole 3F into which the two protrusions 2E, 2E are fitted. That is, the slider 1 may have a structure in which the stepped portions 2G on the first slider member 2 and the protrusions 3G on the second slider member 3 are interchanged with each other.

As shown in FIG. 5(C), the inner walls 2H, 2H of the first slider member 2 that is provided with the protrusions 2E, 2E are tapered so as to be fitted easily to the mouth E of the reclosable bag W in the sliding direction. Also, as shown in FIG. 7(B), stepped portions 3H, 3H are formed at an exit end on the inner surfaces of the hole 3F in the second slider member 3, while bosses 2I, 2I to be caught by the stepped portions 3H, 3H are formed on the respective protrusions 2E, 2E on the first slider member 2. This structure allows the first and second slider members 2 and 3 not to be separated easily, that is, to be fitted stably to each other.

Figure 11:
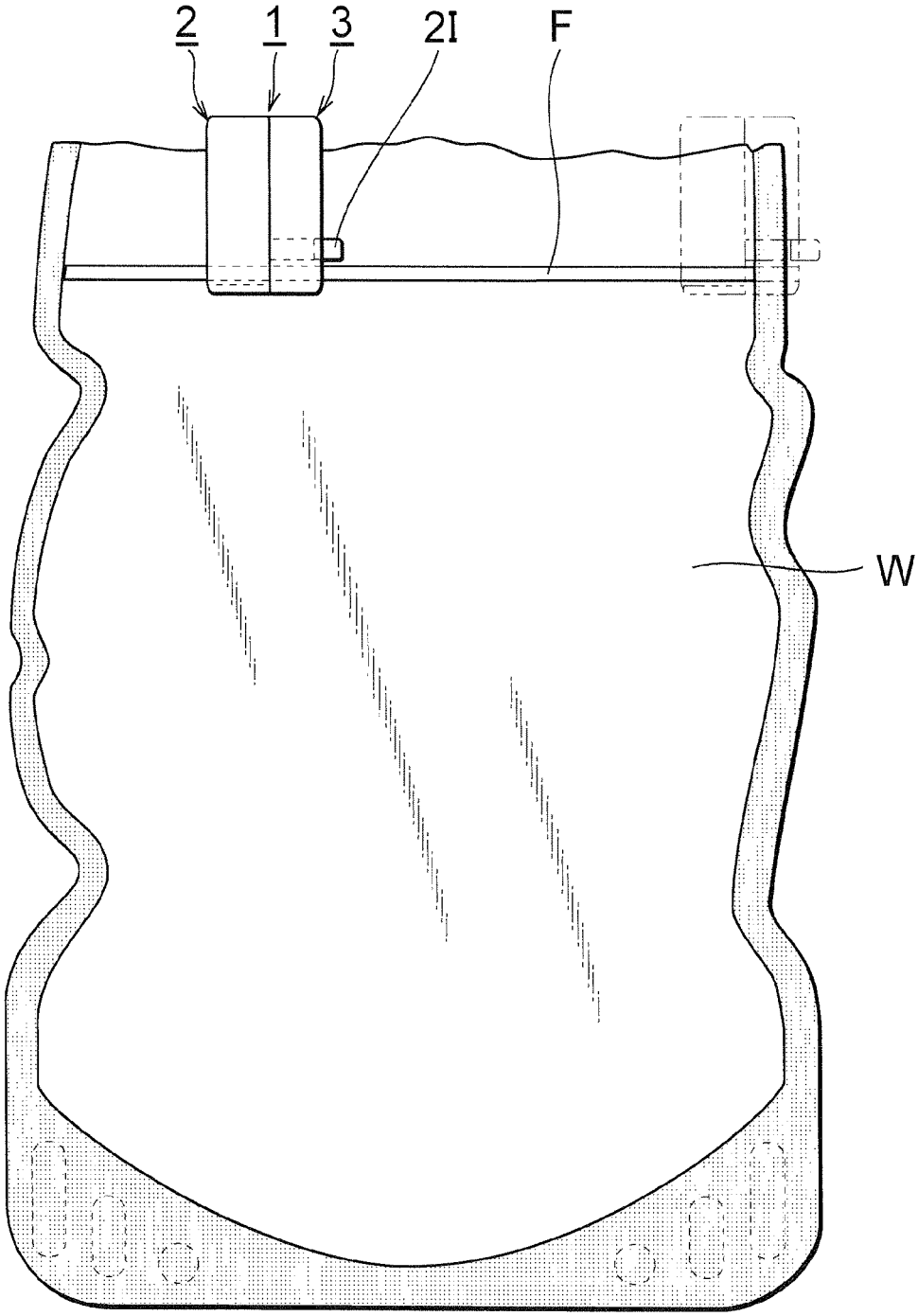
FIG. 11 is a front view showing a state where a vertically-elongated slider is fitted to a fastener of a reclosable bag.
Figure 12A:
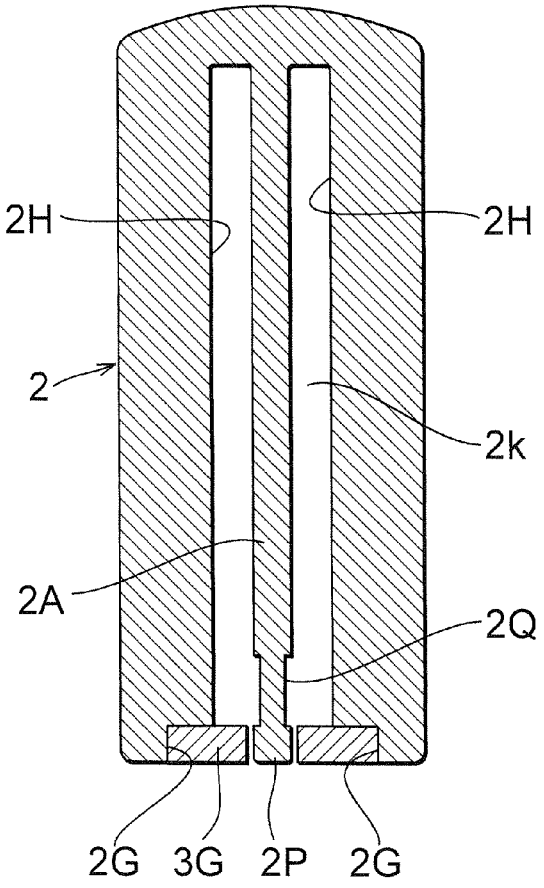
FIG. 12(A) is a cross-sectional view similar to that along the arrows D-D in FIG. 5(B) in the case where the space between inner walls of the first slider member is elongated vertically.
Figure 12B:
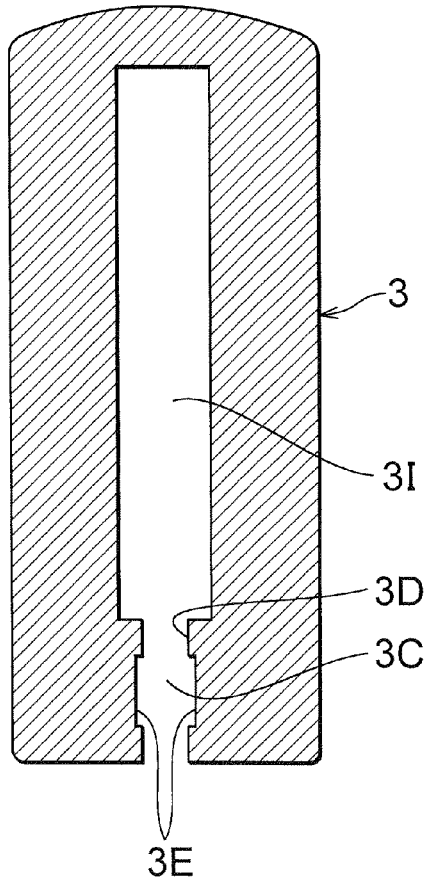
FIG. 12(B) is a cross-sectional view in the case where the space over the narrowed portion in the second slider member is elongated.

It is noted that some sealed reclosable bags with a fastener have a long distance from a broken edge to the fastener, as shown in FIG. 11. Vertically-elongated slider members 2 and 3 may be employed in this case. That is, the space 2*k* between the inner walls 2H and 2H as well as the projections 2A and 2J of the first slider member 2 may be elongated vertically as shown in FIG. 12(A), and the space 3I over the narrowed portion 3C in the second slider member 3 may also be elongated vertically as shown in FIG. 12(B). FIG. 11 shows a state where the thus arranged slider 1 is fitted to the reclosable bag W.

Figure 13:
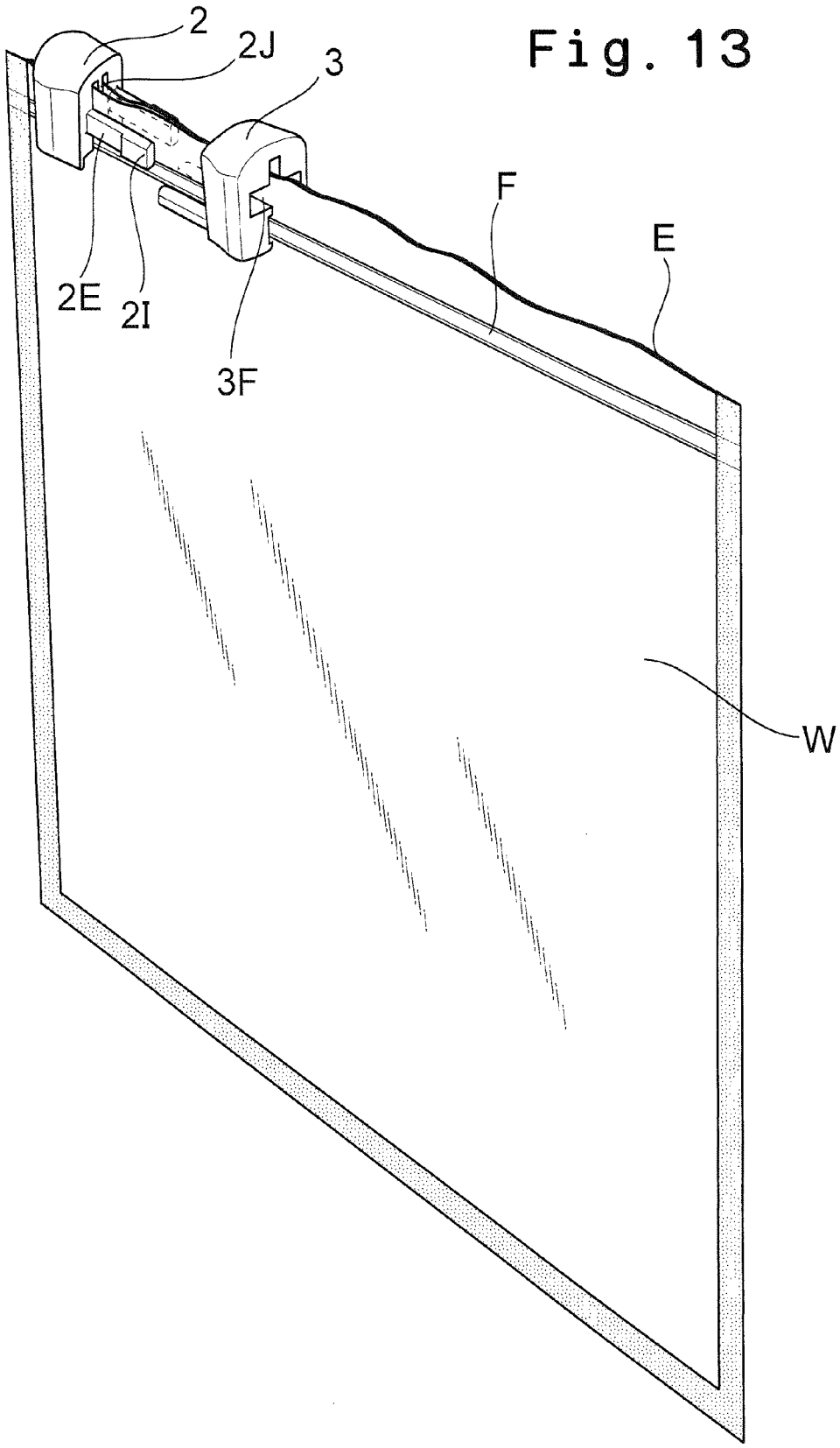
FIG. 13 is a perspective view of the slider for fastener according to the present invention as shown in FIG. 1 in process of being fitted to a fastener of a reclosable bag.
Figure 14:
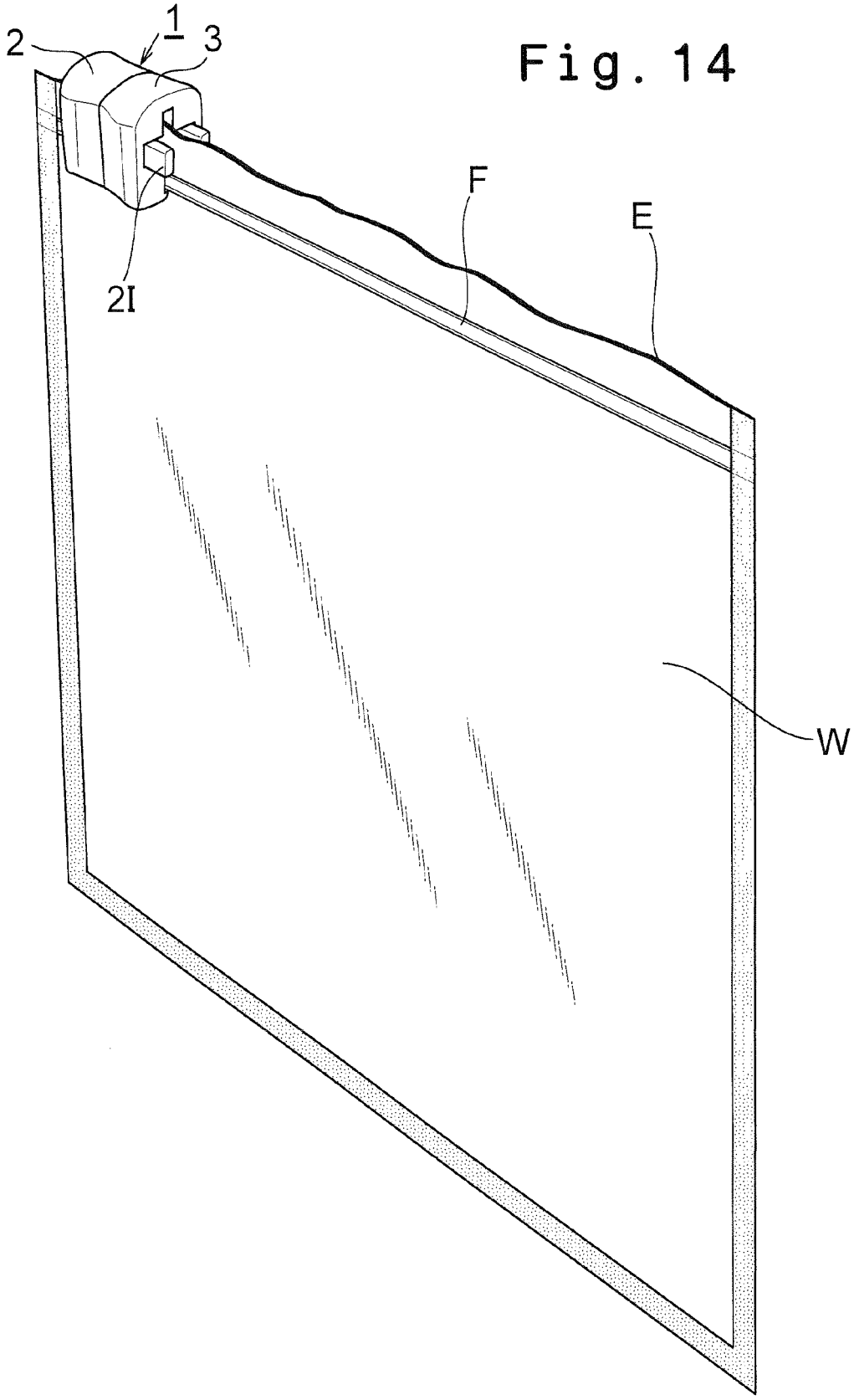
FIG. 14 is a perspective view of the slider for fastener according to the present invention as shown in FIG. 1 after fitted to the fastener of the reclosable bag.

FIG. 13 is a perspective view of the slider 1 for fastener according to the present invention in process of being fitted to a fastener F included in a sealed reclosable bag W after broken at the end portion thereof, where the first and second slider members 2 and 3 are fitted separately. FIG. 14 is a perspective view of the slider 1 for fastener according to the present invention after fitted and assembled to the reclosable bag W.

The projections 2A and 2J of the first slider member 2 are first inserted from above through the mouth E in a closed state of the reclosable bag W in Such a manner as to disengage the projected streak portion F3 of the male engageable member F1 from the engagement groove F4 of the female engageable member F2, both included in the fastener F of the broken sable bag W. Next, the narrowed portion 3C in the second slider member 3 is fitted at the other end in the sliding direction to the fastener F at the mouth E of the reclosable bag W, and then the two protrusions 2E, 2E on the first slider member 2 are fitted into the hole 3F in the second slider member 3. At the same time, the protrusions 3G, 3G on the second slider member 3 are fitted to the stepped portions 2G, 2G on the first slider member 2. The fastener F is then fitted to the grooves 3E as shown in FIG. 9.

The first and second slider members 2 and 3 are thus fitted firmly to each other as shown in FIG. 14. Then, the fastener F at the mouth E of the bag W can be opened and closed by sliding the slider 1 back and forth.

Figure 15A:
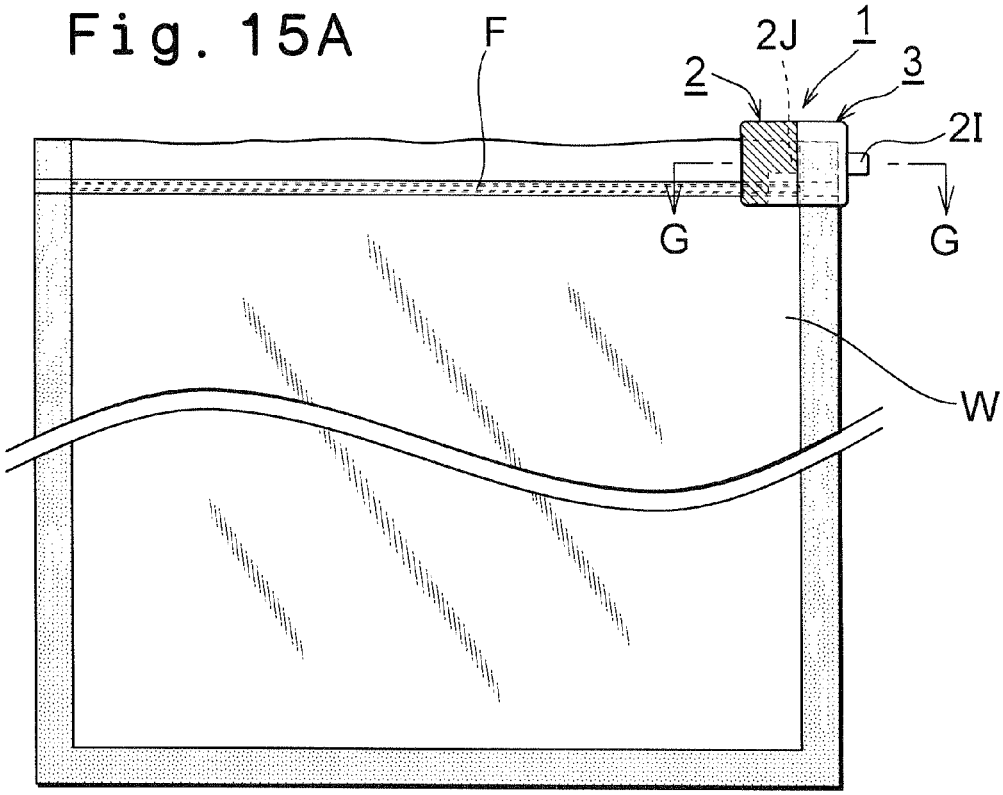
FIG. 15(A) shows a state where the slider fitted to the mouth E of the reclosable bag W reaches one end of the fastener.
Figure 15B:
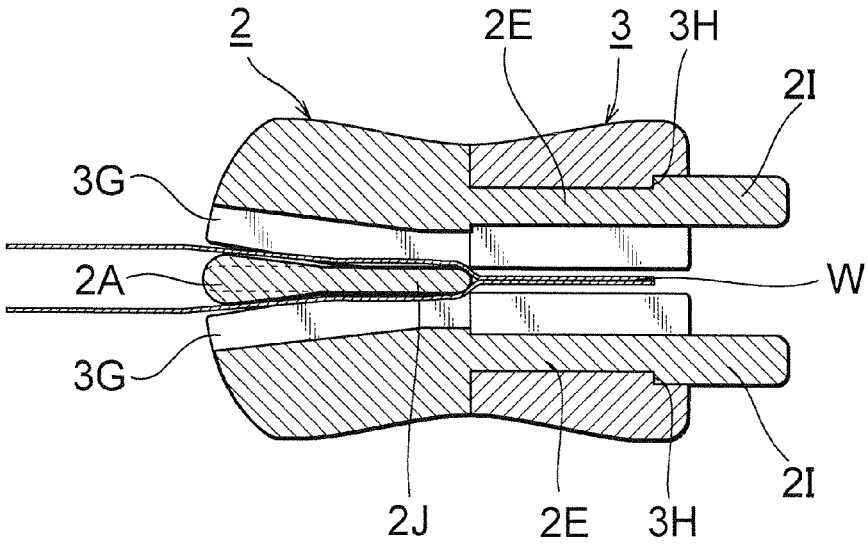
FIG. 15(B) is a cross-sectional view along the arrows G-G in FIG. 15(A).

FIG. 15(A) shows a state where the slider 1 fitted to the mouth E of the reclosable bag W reaches one end of the fastener F, and FIG. 15(B) is a cross-sectional view along the arrows G-G in FIG. 15(A). When the slider 1 for fastener reaches one end of the fastener F, the second slider member 3 travels outside the end of the reclosable bag, but the projection 2J, which is provided on the first slider member 2 with a height smaller than and a width greater than those of the projection 2A, hits the end of the mouth E of the reclosable bag W and stops there. Similarly, even when the slider 1 for fastener may reach the other end of the reclosable bag W, the projection 2A comes into contact with the end of the reclosable bag W, whereby the slider 1 for fastener cannot also fall off. Accordingly, the slider 1 for fastener can be stabilized not to easily fall off from the mouth E of the reclosable bag W. It is noted that when the first and second slider members 2 and 3 are fitted to each other, the bosses 2I on the respective protrusions 2E are stably caught by the stepped portions 3H formed at the end of the hole 3F in the second slider member 3, as shown in FIG. 15(B).

On the other hand, the slider 1 for fastener fitted to the mouth E of the reclosable bag W can be separated and removed easily by pinching the two protrusions 2E, 2E on the first slider member, which extend a little out of the hole 3F in the second slider member 3 as shown in FIG. 1, so as to be deformed elastically and thereby made a little narrower than the hole 3F. Thus, the slider 1 can be disassembled and removed from the reclosable bag W into the first and second slider members 2 and 3 (the first slider member 2 remove upward, while the second slider member 3 is removed laterally), and then fitted again to a mouth E of another reclosable bag W.

A second preferred embodiment of the present invention will hereinafter be described specifically in detail with reference to the accompanying drawings.

Figure 16A:
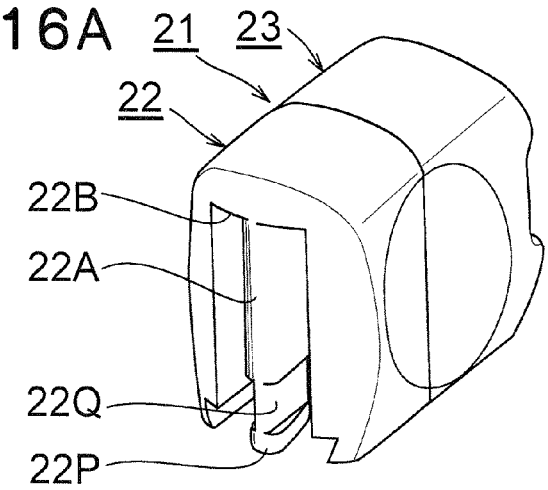
FIG. 16(A) is an overall perspective view of the slider 1 for fastener according to the second preferred embodiment of the present invention in an assembled state.
Figure 16B:
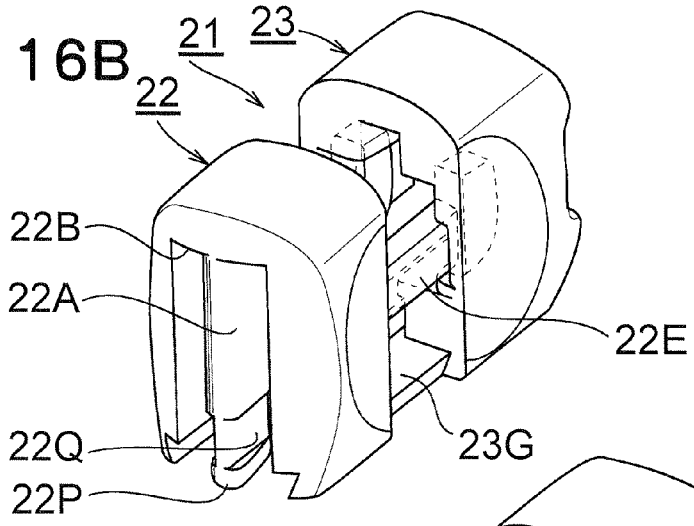
FIG. 16(B) is a perspective view showing a semi-fitted state where the first slider member 22 is pulled a little out of the second slider member.
Figure 16C:
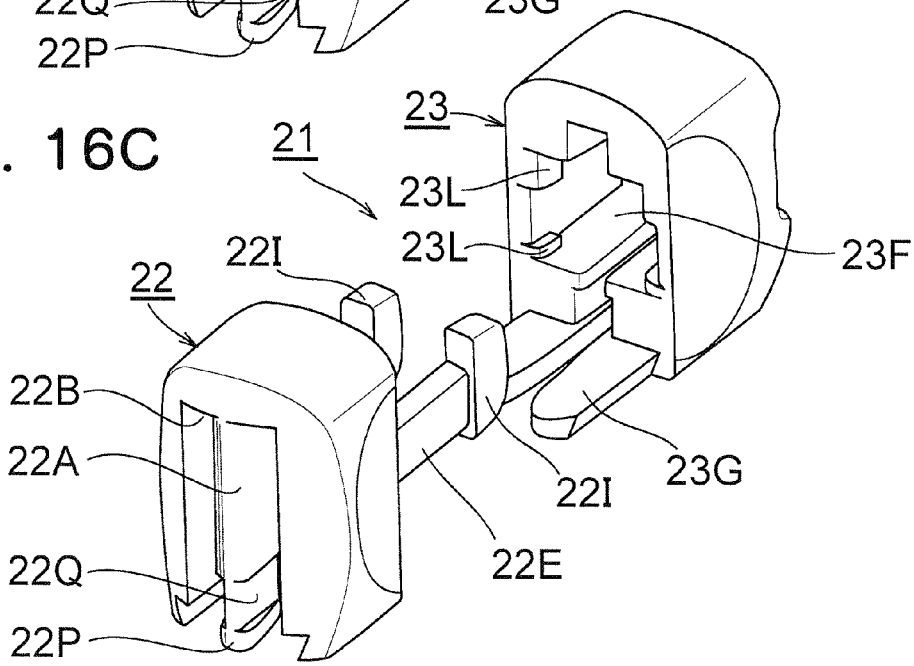
FIG. 16(C) is a perspective view in a separated state.
Figure 17A:
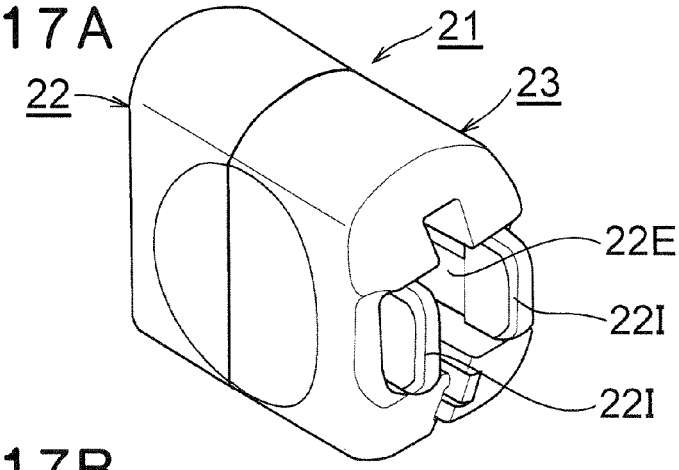
FIG. 17(A) is an overall perspective view in an assembled state.
Figure 17B:
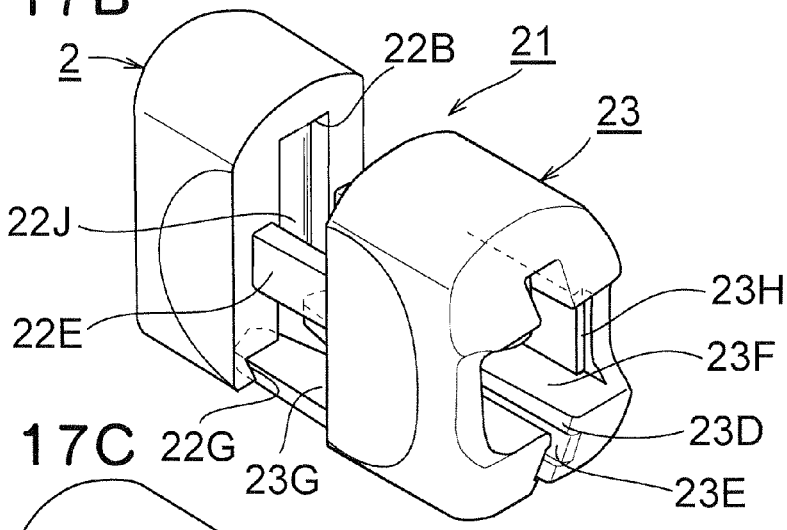
FIG. 17(B) is a perspective view showing a semi-fitted state where the first slider member 22 is pulled a little out of the second slider member.
Figure 17C:
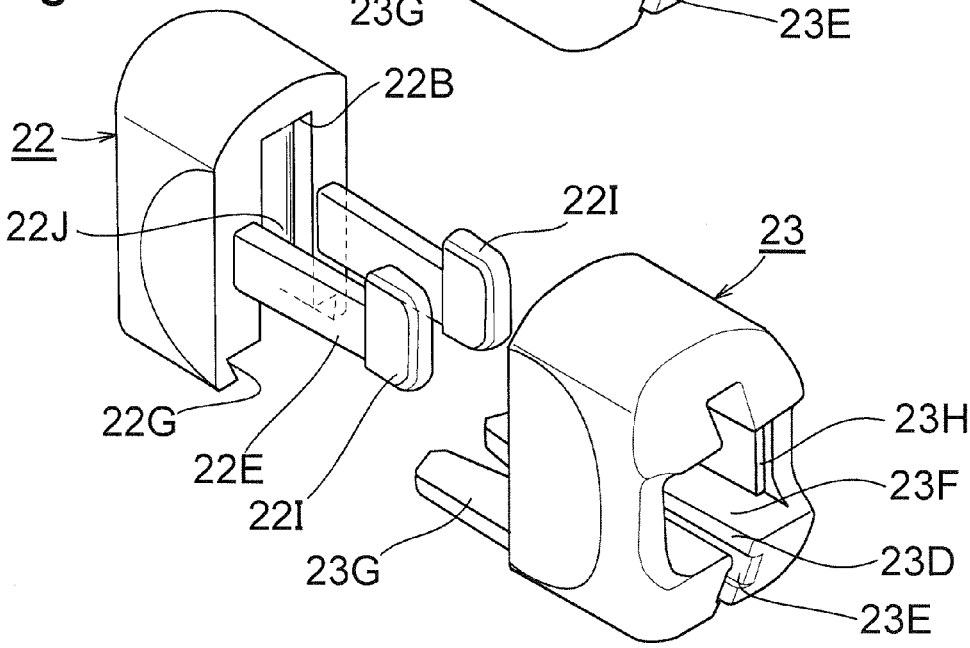
FIG. 17(C) is a perspective view in a separated state.
Figure 18A:
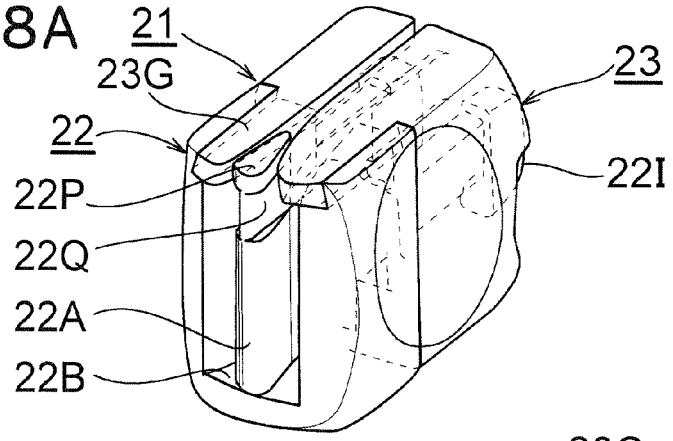
FIG. 18(A) is an overall perspective view in an assembled state.
Figure 18B:
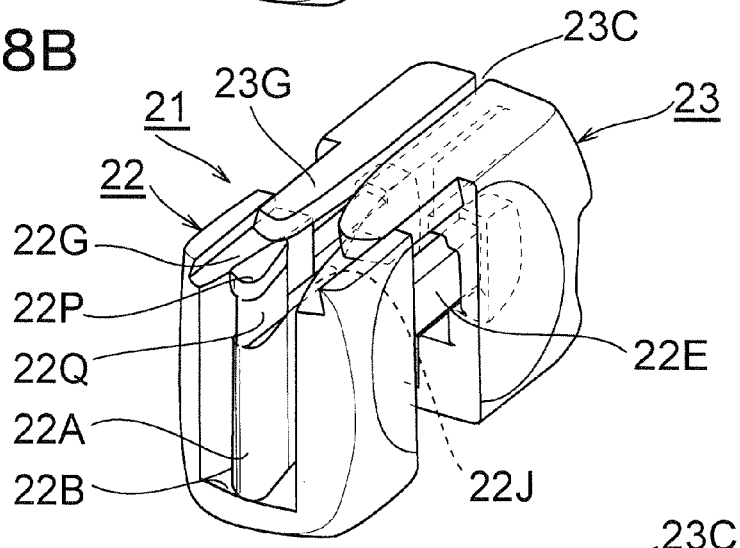
FIG. 18(B) is a perspective view showing a semi-fitted state where the first slider member 22 is pulled a little out of the second slider member.
Figure 18C:
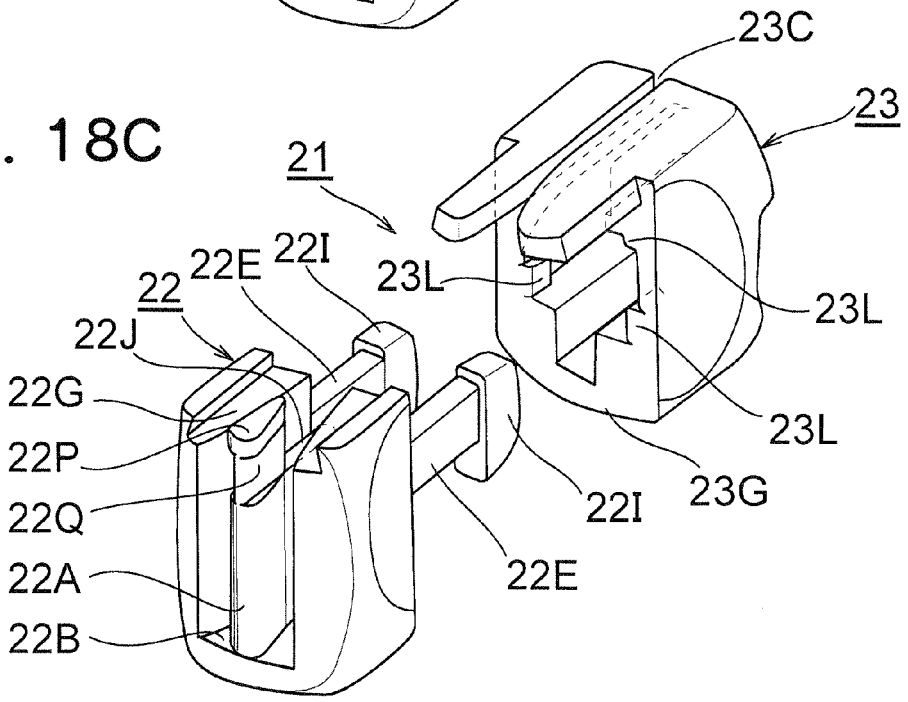
FIG. 18(C) is a perspective view in a separated state.

FIG. 16(A) is an overall perspective view of the slider 1 for fastener according to the second preferred embodiment of the present invention in an assembled state, FIG. 16(B) is a perspective view showing a semi-fitted state where a first slider member 22 is pulled a little out of a second slider member, and FIG. 16(C) is a perspective view in a separated state. FIG. 17 shows the second preferred embodiment of the present invention, viewed in a direction different from that of FIG. 16, where FIG. 17(A) is an overall perspective view in an assembled state; FIG. 17(B) is a perspective view showing a semi-fitted state where the first slider member 22 is pulled a little out of the second slider member; and FIG. 17(C) is a perspective view in a separated state. FIG. 18 shows the slider for fastener according to the second preferred embodiment of the present invention, turned upside down, where FIG. 18(A) is an overall perspective view in an assembled state; FIG. 18(B) is a perspective view showing a semi-fitted state where the first slider member 22 is pulled a little out of the second slider member 23; and FIG. 18(C) is a perspective view in a separated state.

Also in the second preferred embodiment of the present invention, the projection 22A of the first slider member 22 is provided in a standing manner on an inner bottom portion 22B. That is, the slider 21 for fastener according to the present invention includes the projection 22A, which is adapted to disengage a male engageable member F1 and a female engageable member F2 of a fastener, and another projection 22J having a height smaller than that of the projection 22A.

The slider 21 also includes the first slider member 22 formed with two protrusions 22E, 22E and a second slider member 23 formed with a narrowed portion 23C for engaging the male and female engageable members F1 and F2 with each other. The projection 22A of the first slider member 22 is provided in a standing manner on the bottom portion 22B, while the two protrusions 22E, 22E are provided in a manner extending toward the second slider member 23 and also in a standing manner on a fitting surface 22C that faces the second slider member 23. Further, a through hole 23F into which the two protrusions 22E, 22E are fitted is provided in the second slider member 23. The thus arranged slider 21 has a structure in which the two protrusions 22E, 22E on the first slider member 22 extend a little out of the hole 23F in the second slider member 23 when the first and second slider members 22 and 23 are fitted to each other.

Grooves 23E, 23E into which the fastener F is to be fitted naturally are provided in sidewalls 23D, 23D on either side of the narrowed portion 23C formed in the second slider member 23. The convex bulge formed by the male and female engageable members F1 and F2 is to be fitted to the grooves 23E, 23E, whereby the slider 21 can be fitted stably to the fastener F of the reclosable bag W (same as in FIG. 9).

The leading end 22P of the projection 22A on the first slider member 22 may be a little rounded to be inserted easily between the engageable members of the fastener F. A constriction 22Q is then provided in the vicinity of the leading end 22P of the projection 22A. When the projection 22A is inserted forcibly between the male and female engageable members F1 and F2 of the fastener, the projected streak portion F3 and the engagement groove F4 of the fastener in an disengaged state are fitted to the constriction 22Q in the vicinity of the leading end 22P, so that the projected streak portion F3 can be disengaged stably from the engagement groove F4 into which the projected streak portion F3 is fitted (same as in FIG. 10). The projection 22A on the first slider member 22 is formed with the projection 22J, which extends continuously in the sliding direction with a height a little smaller than that of the projection 22A.

The hole 23F in the second slider member 23 is provided in a position where the two protrusions 22E, 22E are just fitted when the first and second slider members 22 and 23 are fitted to each other. In this case, the two protrusions 22E, 22E extend a little out of the hole 23F in the second slider member 23. This is for the reason that the two protrusions 22E, 22E in the fitted state shown in FIG. 17(A) can be pinched with fingers. Accordingly, the two protrusions 22E, 22E, when pinched with fingers, deforms elastically to come close to each other and thereby to be pulled easily off the hole 23F (same as in Paragraph [0026]).

Figure 19B:
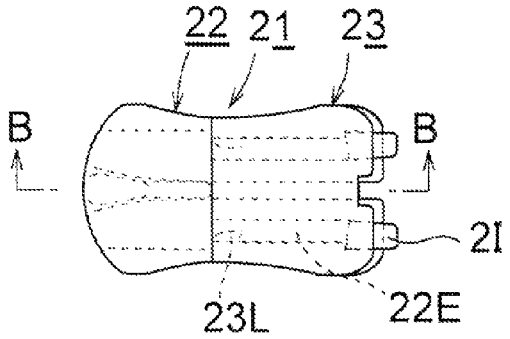
FIGS. 19(A), 19(B), 19(C), 19(D), and 19(E) are, respectively, front, plan, bottom, left side, and right side views according to the second preferred embodiment of the present invention.
Figure 19E:
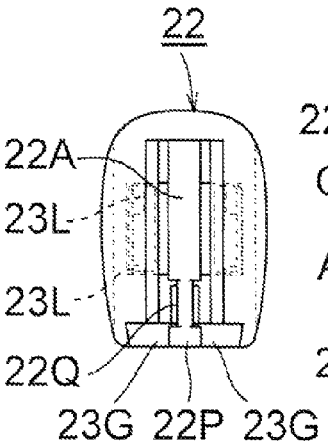
Figure 19A:
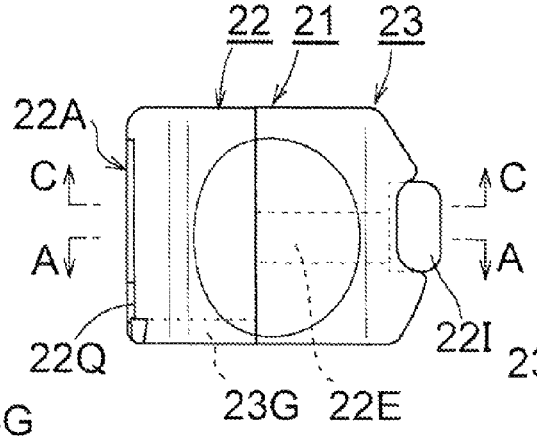
Figure 19C:
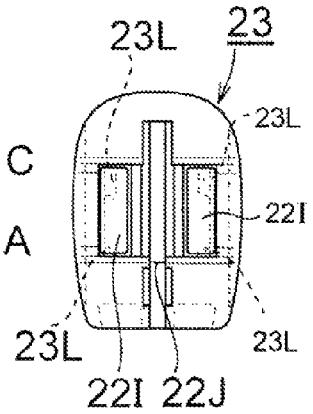
Figure 19D:
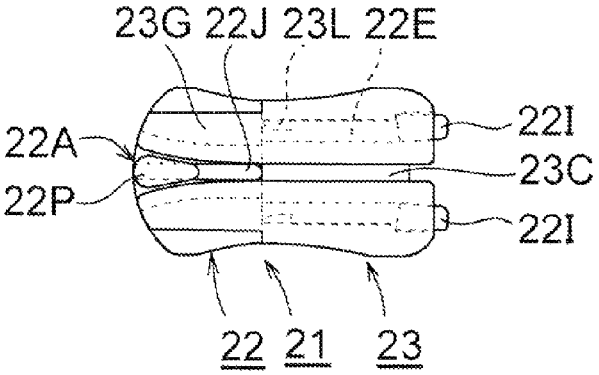
Figure 20A:
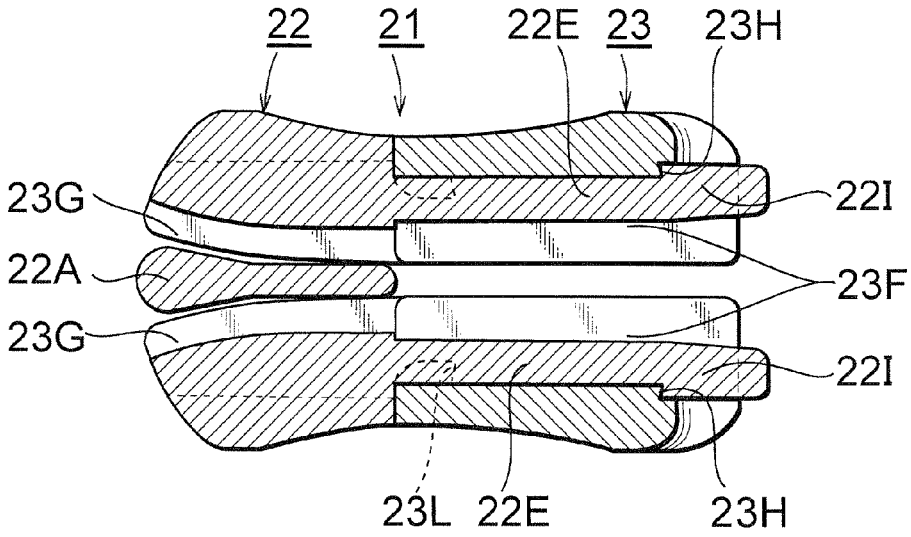
FIG. 20(A) is a cross-sectional view along the arrows A-A in FIG. 19(A)
Figure 20B:
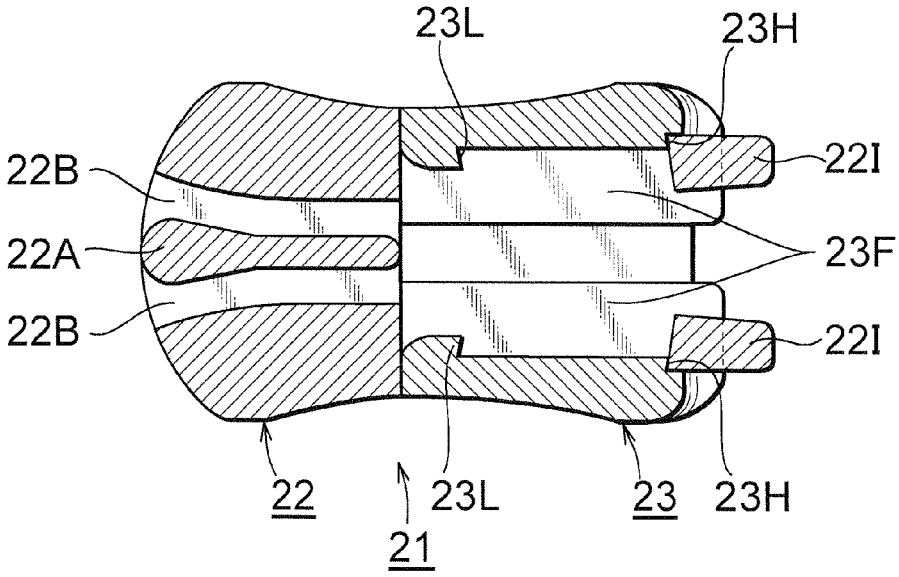
FIG. 20(B) is a cross-sectional view along the arrows C-C in FIG. 19(A).
Figure 21A:
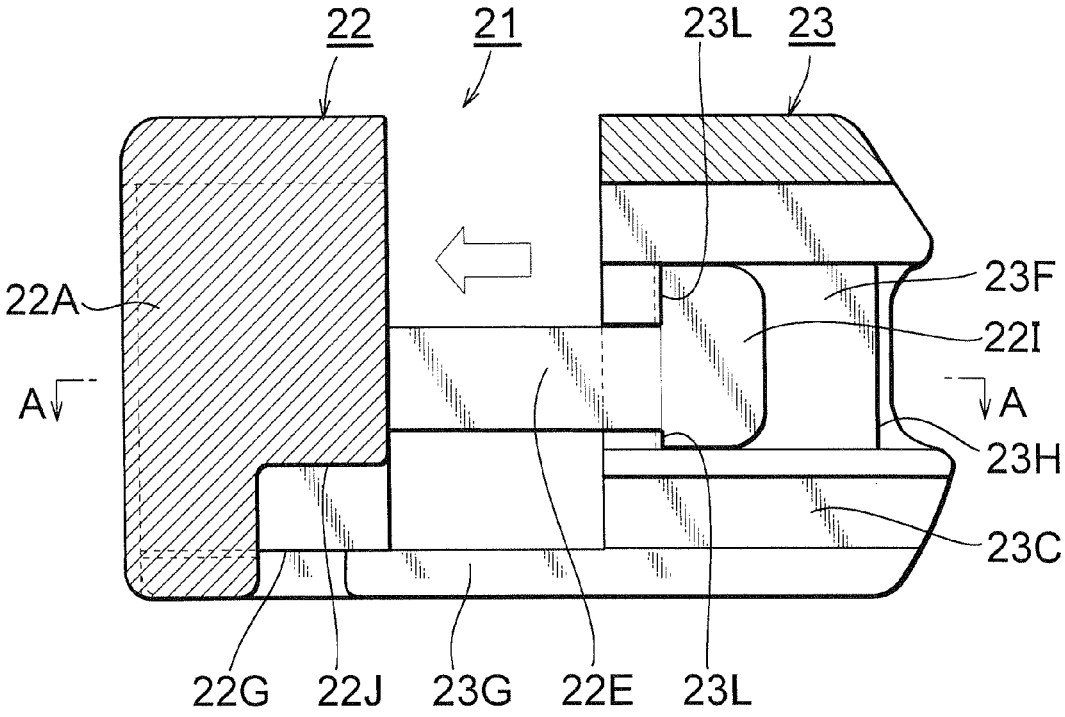
FIG. 21(A) is a cross-sectional view along the arrows B-B in FIG. 19(B), showing a state where bosses on two protrusions are caught by bosses of a hole in the second slider member in process of the first slider member being pulled out of the second slider member 23.
Figure 21B:
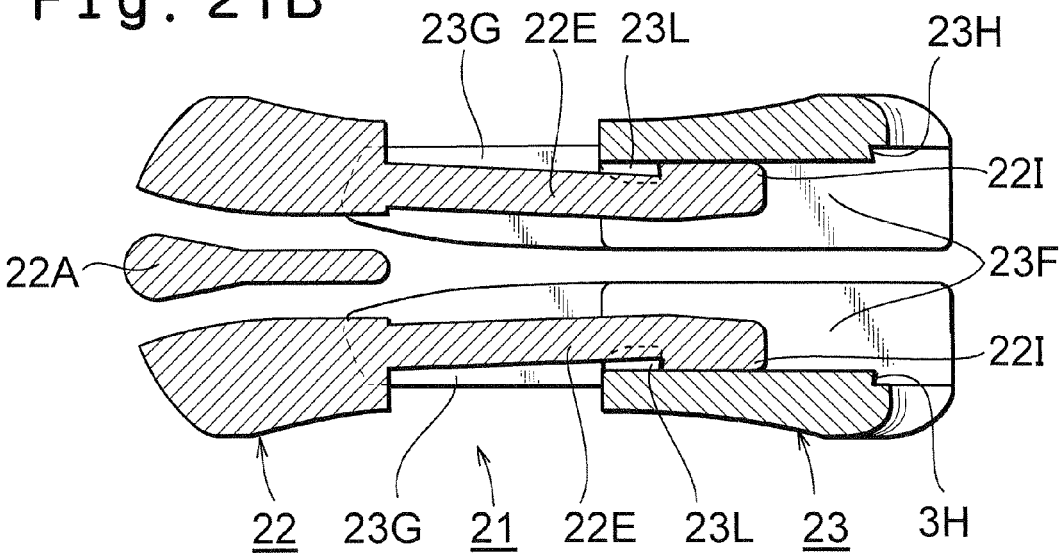
FIG. 21(B) is a cross-sectional view along the arrows A-A in FIG. 21(A), showing the same state.

FIGS. 19(A), 19(B), 19(C), 19(D), and 19(E) are respectively, front, plan, bottom, left side, and right side views according to the second preferred embodiment of the present invention. FIG. 20(A) is a cross-sectional view along the arrows A-A in FIG. 19(A), and FIG. 20(B) is a cross-sectional view along the arrows C-C in FIG. 19(A). FIG. 21(A) is a cross-sectional view along the arrows B-B in FIG. 19(B), showing a state where bosses 22I, 22I on the two protrusions 22E, 22E are caught by bosses 23L of the hole 23F in the second slider member 23 in process of the first slider member 22 being pulled out of the second slider member 23, and FIG. 21(B) is a cross-sectional view along the arrows A-A in FIG. 21(A), showing the same state.

As shown in these figures, in accordance with the second preferred embodiment of the present invention, the first slider member 22 cannot be pulled off the hole 23F in the second slider member 23, even if may be tried, because the two protrusions 22E, 22E are caught by the bosses 23L, 23L of the hole 23F in the second slider member 23 and thereby the first slider member 22 stops there. It is noted that the first slider member 22 in this state can be pulled off the second slider member 23 by pinching the inner protrusions 22E, 22E so as to be deformed elastically.

Figure 22:
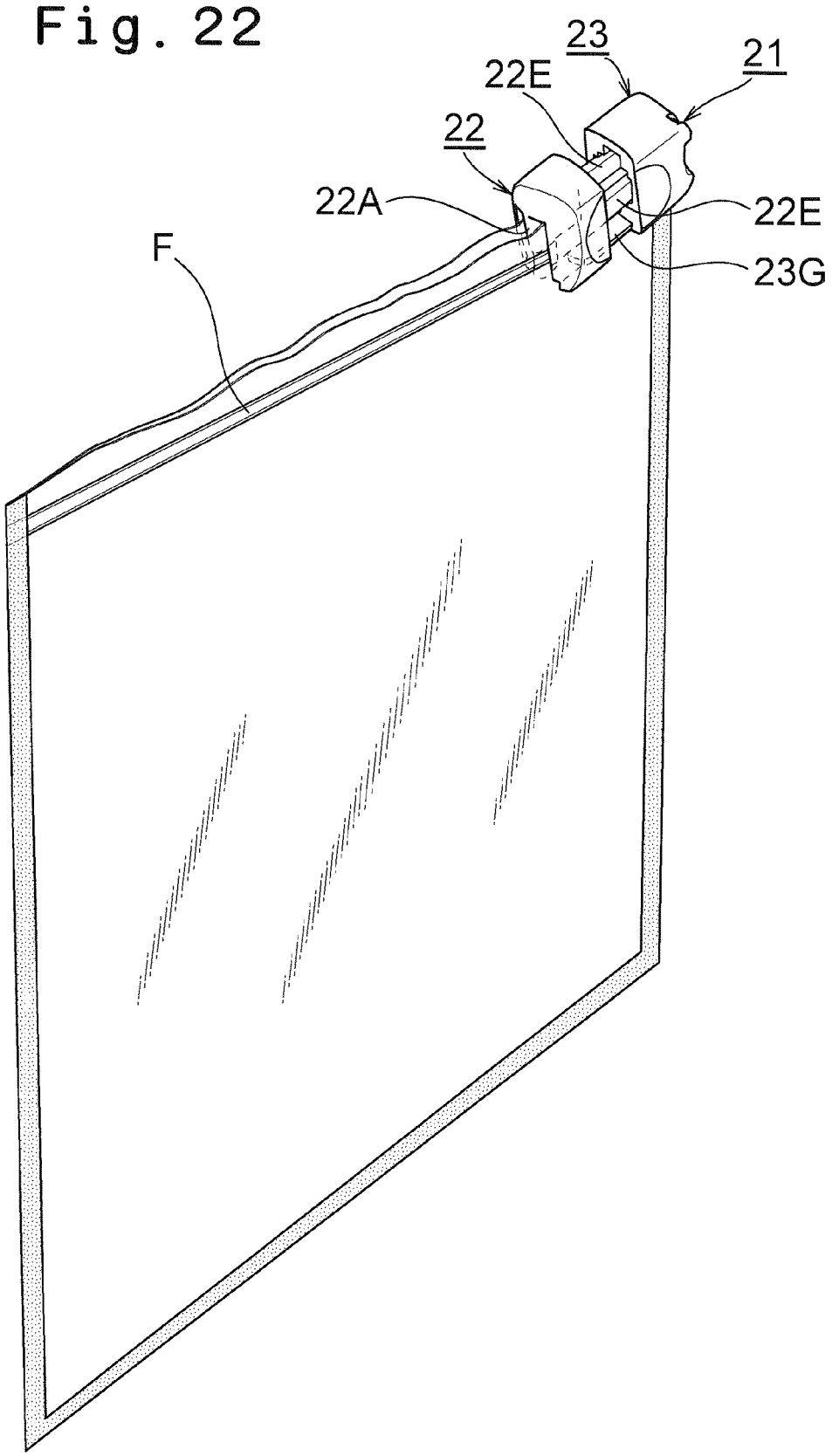
FIG. 22 is an overall perspective view showing a state where the slider for fastener according to the present invention is fitted to a fastener of a reclosable bag W.

FIG. 22 is an overall perspective view showing a state where the slider 21 for fastener according to the present invention is fitted to a fastener F of a reclosable bag W. Next, the slider 21 for fastener can be fitted to the reclosable bag W by pulling the first slider member 22 a little out of the second slider member 23 to cause the slider 21 for fastener to be in a semi-fitted state, fitting the first slider member 22 from above the fastener F of the reclosable bag W at one end of the fastener F, and fitting the second slider member 23 at the other end in the sliding direction. The protrusions 22E, 22E on the first slider member 22 are then put and fitted completely into the hole 23F in the second slider member 23.

Figure 23:
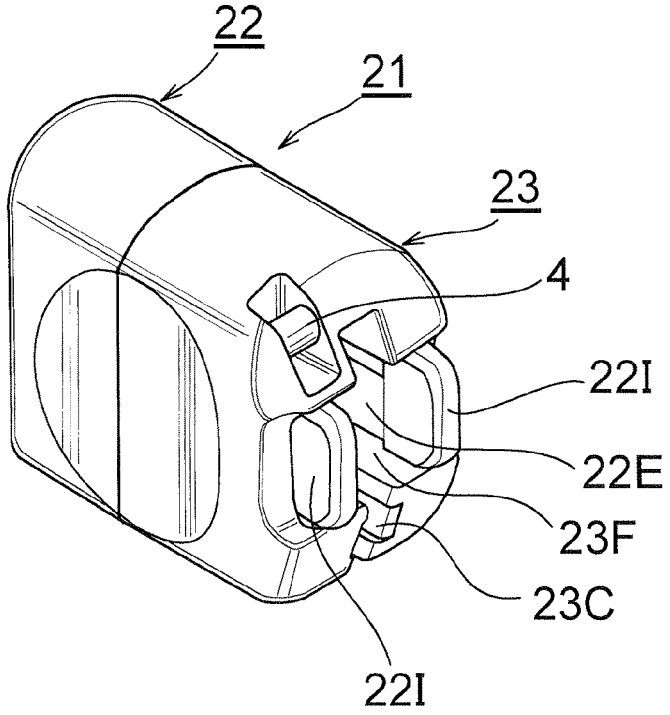
FIG. 23 is a perspective view of the slider for fastener according to the second preferred embodiment of the present invention, in which a strap attachment is provided in the second slider member.

FIG. 23 is a perspective view of the slider 21 for fastener according to the second preferred embodiment of the present invention, in which a strap attachment 4 is provided in the second slider member 23. The slider (1, 21) for fastener according to the present invention can be removed easily from the reclosable bag, if worn out and made unusable, and used in another reclosable bag. A strap may also be attached to the attachment 4 in the slider (1, 21) for fastener according to the present invention so as to advantageously be less likely to be lost.

Figure 24:
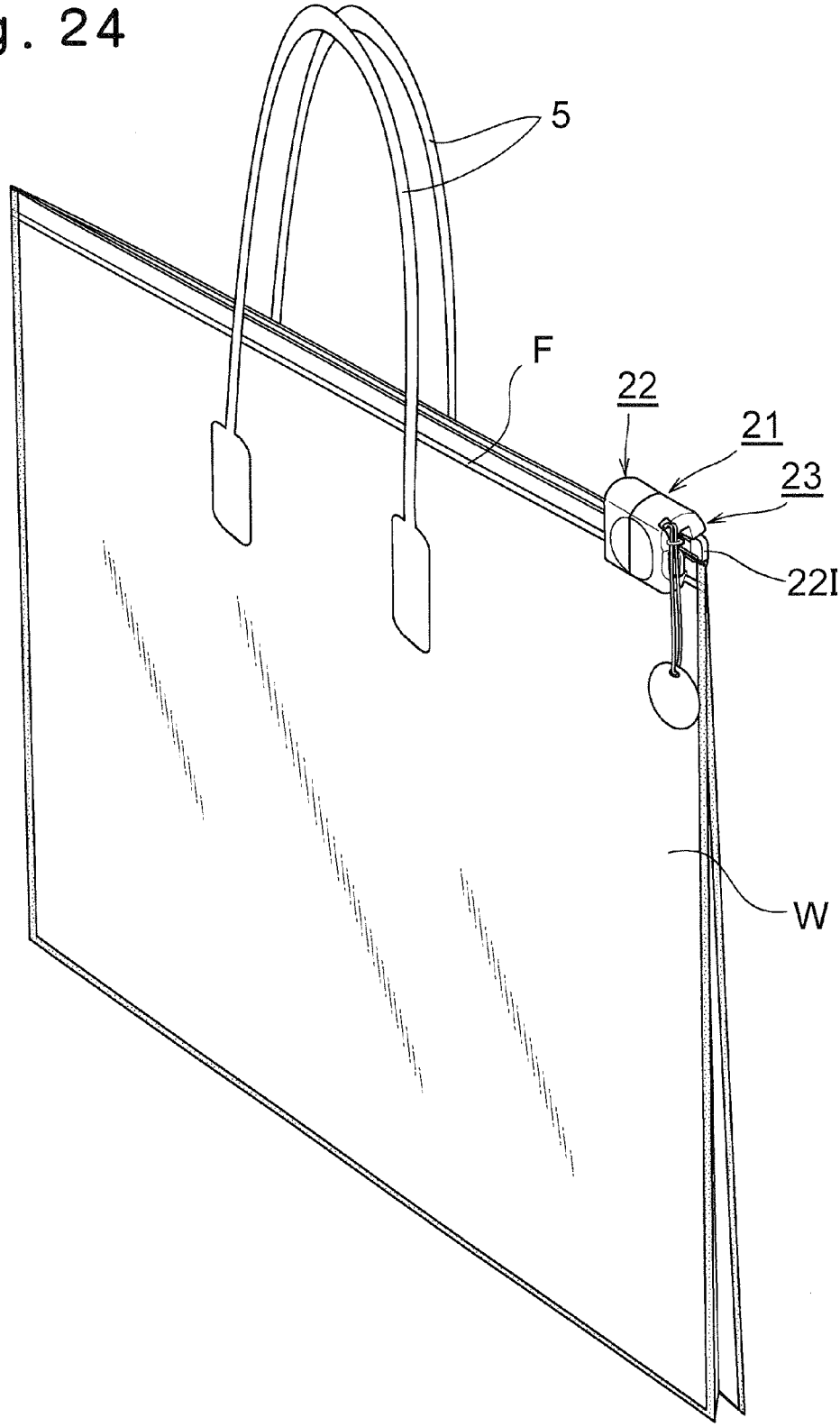
FIG. 24 is a perspective view showing a state where the slider for fastener according to the second preferred embodiment of the present invention is fitted to a fastener of a reclosable bag such as a fashion bag in a manner that a strap is attached to the attachment of the slider for fastener.
Figure 25:
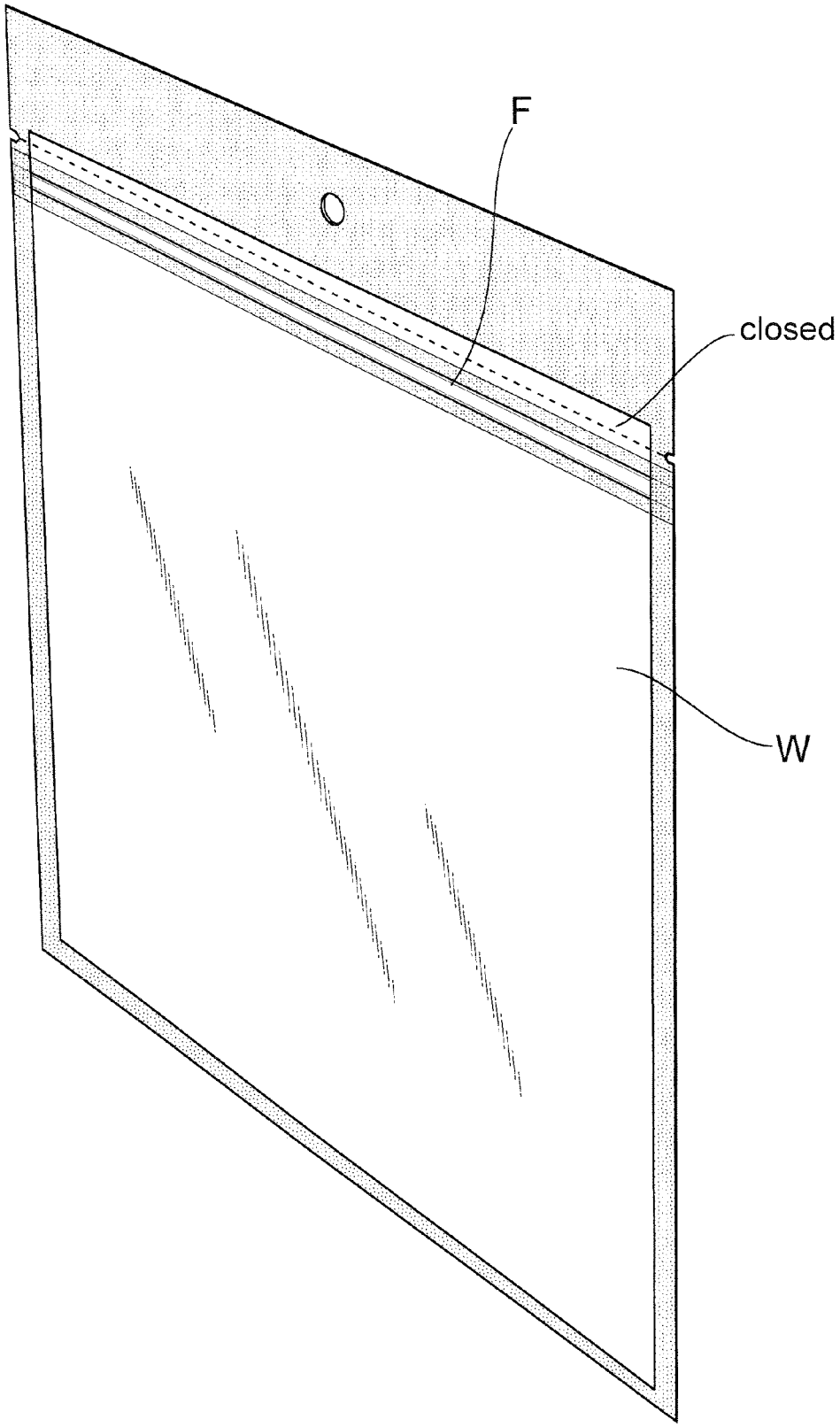
FIG. 25 is an overall perspective view of a conventional sealed reclosable bag.
Figure 26:
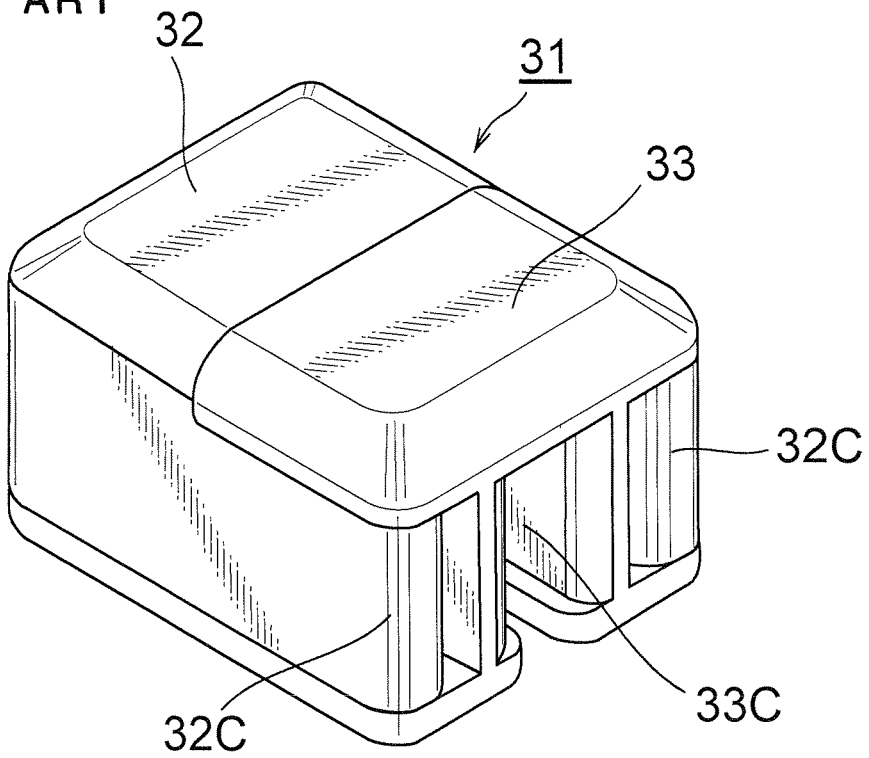
Fig. 26 PRIOR ART
FIG. 26 is a perspective view of a conventional separable slider for fastener used in conventional reclosable bags with a fastener.
Figure 27:
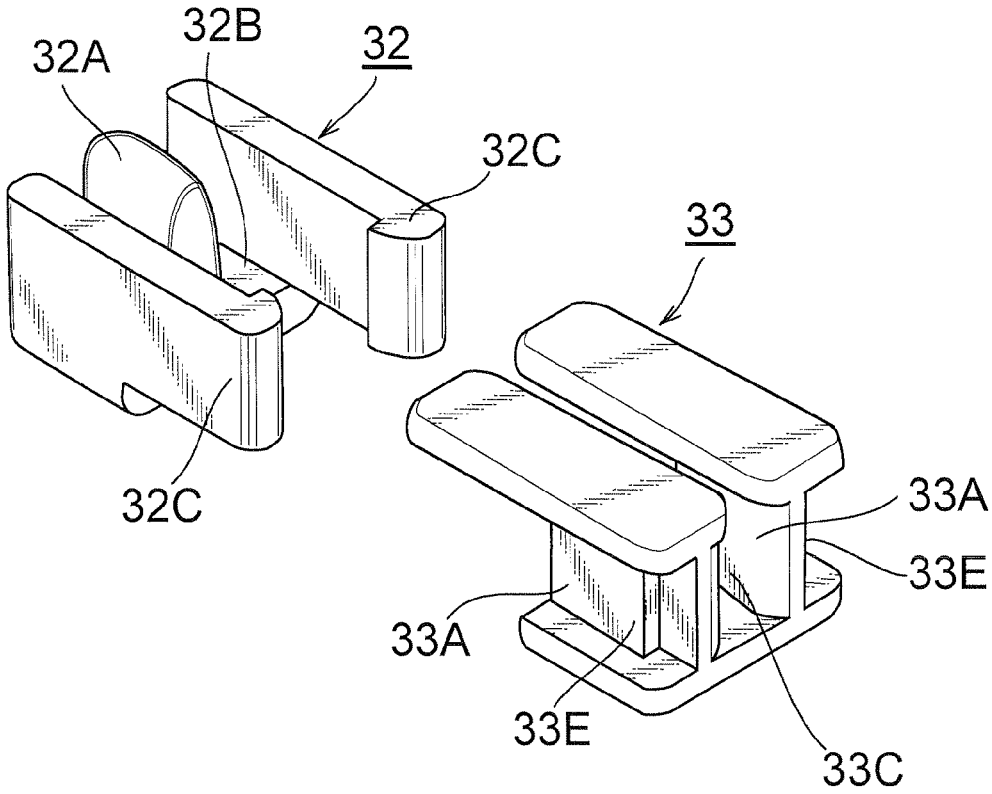
Fig. 27 PRIOR ART
FIG. 27 is a perspective view in a separated state of the conventional separable slider for fastener used in conventional reclosable bags with a fastener.
Figure 28A:
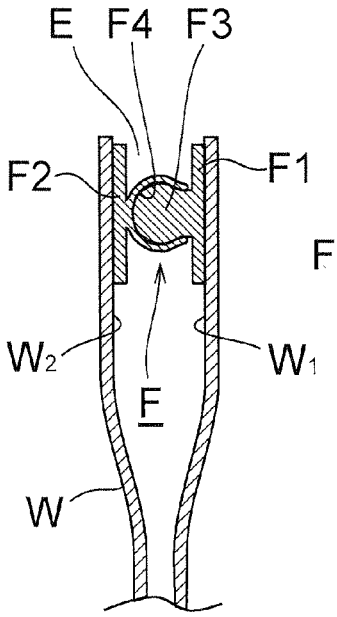
Fig. 28A PRIOR ART
FIG. 28(A) shows the structure of a fastener provided in typical reclosable bags.
Figure 28B:
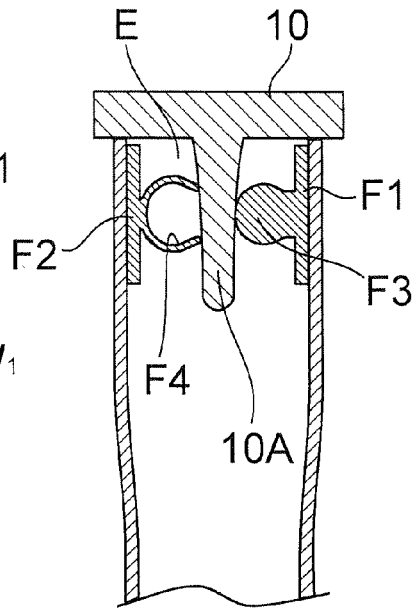
Fig. 28B PRIOR ART
FIG. 28(B) shows a state where a projection of a slider is inserted forcibly into the fastener in a closed state to open the fastener.
Figure 28C:
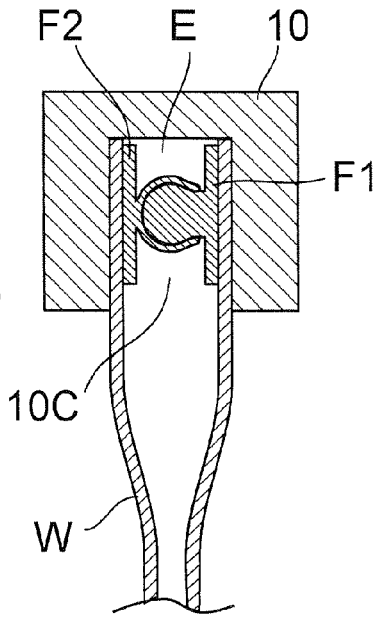
Fig. 28C PRIOR ART
FIG. 28(C) shows a state where the fastener in an opened state is closed by the narrowed portion of the slider.
Figure 29A:
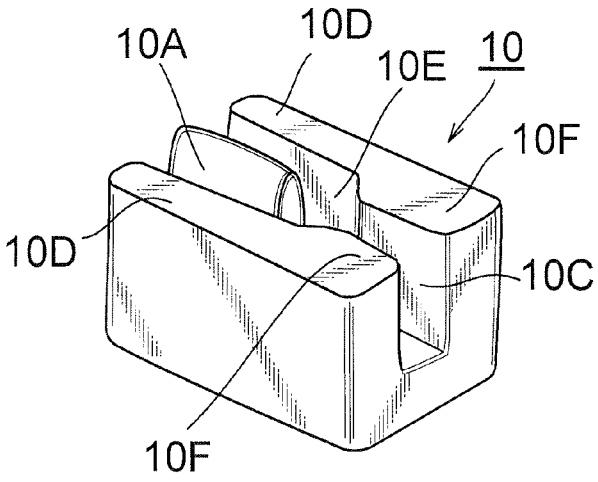
Fig. 29A PRIOR ART
FIG. 29(A) is an overall perspective view of a conventional single-piece slider for fastener.
Figure 29B:
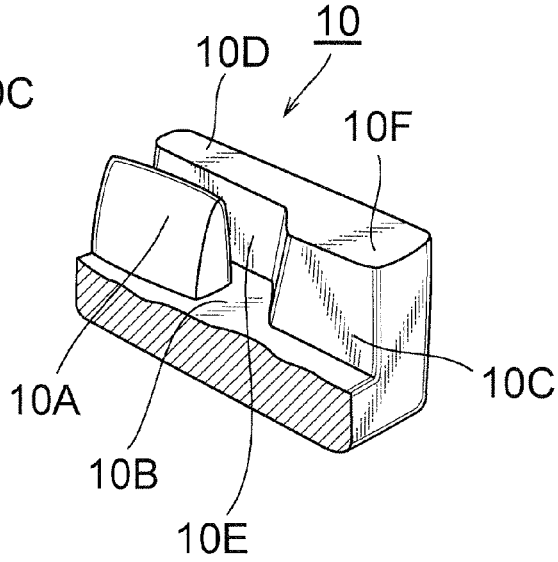
Fig. 29B PRIOR ART
FIG. 29(B) is a perspective view of the slider in half.
Figure 30:
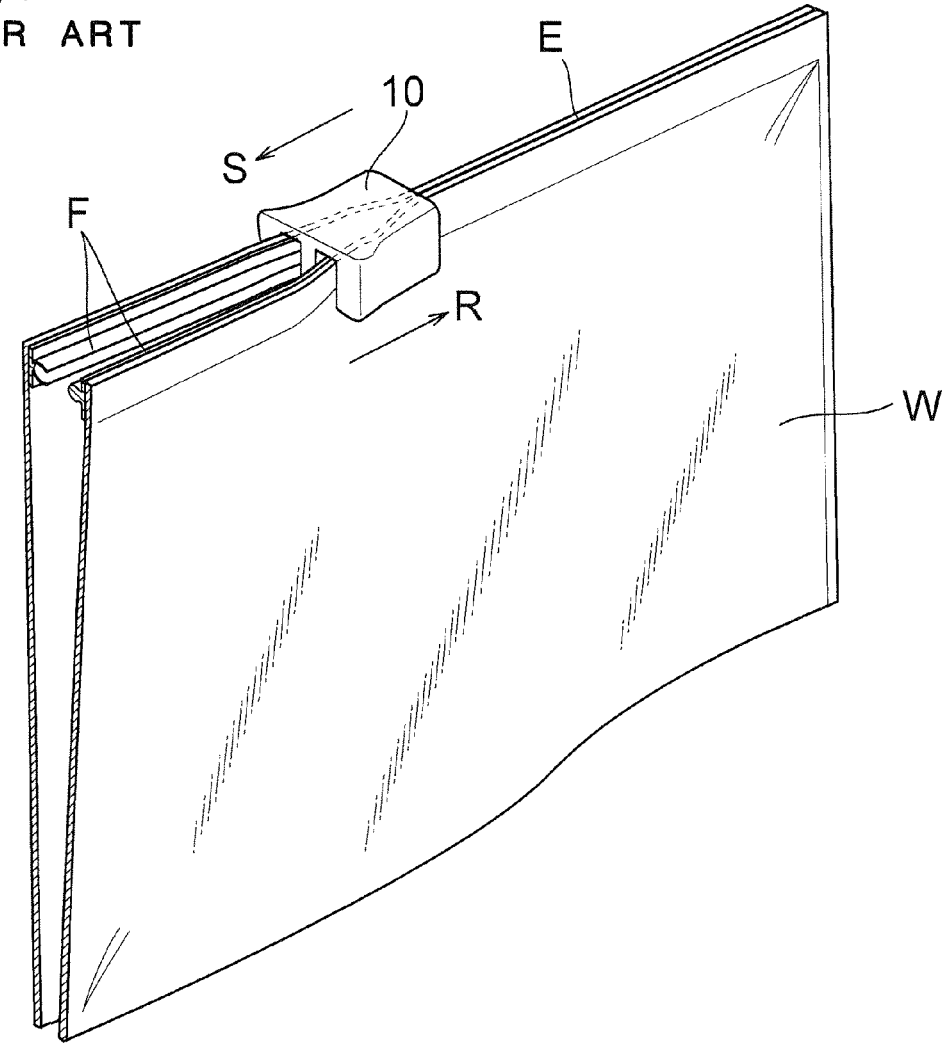
Fig. 30 PRIOR ART
FIG. 30 is a perspective view showing a state where a conventional slider is fitted to a fastener provided at a mouth of a conventional reclosable bag.

FIG. 24 is a perspective view showing a state where the slider 21 for fastener according to the second preferred embodiment of the present invention is fitted to a fastener F of reclosable bag such as a fashion bag. The slider (1, 21) according to the present invention may be fitted to a fastener F of a fashion bag. This looks dressed up (pretty) and feels comfortable to carry around the bag with the slider. Particularly, since a strap can be attached to the attachment 4 as shown in FIG. 23, using mascot animals and goods may enhance the sales of fashion bags.

REFERENCE NUMERALS

1 Slider
2 First slider member
2A Projection of the first slider member
2B Bottom portion of the first slider member
2C Fitting surface wall of the first slider member
2E Protrusion on the first slider member
2I Boss on the protrusion on the first slider member
2J Another projection extending continuously in the sliding direction from the projection of the first slider member
2P Leading end
2Q Constriction of the projection
3 Second slider member
3C Narrowed portion in the second slider member
3E Recessed groove
3F Hole in the second slider member
3L Boss of the hole in the second slider member
4 Attachment

The invention claimed is:

1. A slider for fastener comprising:

a first slider member formed with a projection for disengaging a male engageable member from a female engageable member both included in a fastener, the male engageable member having a projected streak portion and the female engageable member having an engagement groove into which the projected streak portion is fitted engageably and disengageably, the male and female engageable members being provided, respectively, on one inner surface and an other inner surface opposed to the one inner surface in an openable end portion of a reclosable bag; and a second slider member formed with a narrowed portion for engaging the male and female engageable members with each other, said slider for fastener being formed by fitting said first and second slider members to each other, wherein said first slider member is formed with said projection, which is adapted to be inserted forcibly between the male and female engageable members included in the fastener of the reclosable bag in an engaged state from outside the fastener, and two protrusions extending toward said second slider member, and wherein said second slider member is provided with said narrowed portion, which is adapted to engage the male and female engageable members with each other, and a hole into which said two protrusions are fitted, wherein the narrowed portion extends completely through the second slider member in a sliding direction thereof, and wherein the entire narrowed portion is adapted to engage the male and female engageable members with each other, wherein, with respect to the engagement and disengagement of the male and female engageable members, said first slider member functions only to disengage the male and female engageable members with each other, and said second slider member functions only to engage the male and female engageable members with each other, and said slider for fastener having a structure in which said two protrusions on said first slider member extend out of said hole in said second slider member when said first and second slider members are fitted to each other.

2. A slider for fastener comprising:

a first slider member formed with a projection for disengaging a male engageable member from a female engageable member both included in a fastener, the male engageable member having a projected streak portion and the female engageable member having an engagement groove into which the projected streak portion is fitted engageably and disengageably, the male and female engageable members being provided, respectively, on one inner surface and an other inner surface opposed to the one inner surface in an openable end portion of a reclosable bag; and a second slider member formed with a narrowed portion for engaging the male and female engageable members with each other, said slider for fastener being formed by fitting said first and second slider members to each other, wherein said first slider member is formed with said projection, which is adapted to be inserted forcibly between the male and female engageable members included in the fastener of the reclosable bag in an engaged state from outside the fastener, and two protrusions extending toward said second slider member and each having a boss at a leading end thereof, and wherein said second slider member is provided with said narrowed portion, which is adapted to engage the male and female engageable members with each other, and a hole into which said two protrusions are fitted, said hole being formed with recessed portions at an exit end thereof to which said bosses at the leading ends of said two protrusions are fitted respectively, wherein the narrowed portion extends completely through the second slider member in as sliding direction thereof, and wherein the entire narrowed portion is adapted to engage the male and female engageable members with each other, wherein, with respect to the engagement and disengagement of the male and female engageable members, said first slider member functions only to disengage the male and female engageable members with each other, and said second slider member inactions only to engage the male and female engageable members with each other, and said slider for fastener having a structure in which said two protrusions on said first slider member extend out of said hole in said second slider member when said first and second slider members are fitted to each other.

3. A slider for fastener comprising:

a first slider member formed with a projection for disengaging a male engageable member from a female engageable member both included in a fastener, the male engageable member having a projected streak portion and the female engageable member having an engagement groove into which the projected streak portion is fitted engageably and disengageably, the male and female engageable members being provided, respectively, on one inner surface and an other inner surface opposed to the one inner surface in an ($_7$enable end portion of a reclosable bag; and a second slider member formed with a narrowed portion for engaging the male and female engageable members with each other, said slider for fastener being formed by fitting said first and second slider members to each other, wherein said first slider member is provided with said projection, which is adapted to be inserted forcibly between the male and female engageable members included in the fastener of the reclosable bag in an engaged state from outside the fastener, and two protrusions extending toward said second slider member and each having a boss at a leading end thereof, and wherein said second slider member is provided with said narrowed portion, which is adapted to engage the male and female engageable members with each other, and a hole into which said two protrusions are fitted, said hole being formed with: recessed portions at an exit end thereof to which said bosses at the leading ends of said two protrusions are fitted respectively; and bosses, on a side nearer said first slider member, adapted to be engaged, respectively, with said bosses at the leading ends of said two protrusions provided on said first slider member.

4. The slider for fastener according to any of claims 1 to 3, wherein inner walls on either side of said narrowed portion in said second slider member are each formed with a recessed portion to which a bulge of the fastener of the reclosable bag is fitted.

5. The slider for fastener according to any of claims 1 to 3, adapted to be fitted after a sealed end portion on an outer side of the fastener of the reclosable hag is broken.

6. The slider for fastener according to any of claims 1 to 3, wherein said protection on said first slider member is formed with another projection extending in the sliding direction with a height smaller than that of said first projection.

7. The slider for fastener according to any of claims 1 to 3, wherein a constriction is provided in a vicinity of a leading end of said projection on said first slider member.

* * * * *